US009765935B2

(12) United States Patent
Rowlette, Jr. et al.

(10) Patent No.: US 9,765,935 B2
(45) Date of Patent: Sep. 19, 2017

(54) LED LAMP WITH LED BOARD BRACE

(71) Applicant: Cree, Inc., Durham, NC (US)

(72) Inventors: John R. Rowlette, Jr., Raleigh, NC (US); David Power, Morrisville, NC (US)

(73) Assignee: Cree, Inc., Durham, NC (US)

( * ) Notice: Subject to any disclaimer, the term of this patent is extended or adjusted under 35 U.S.C. 154(b) by 0 days.

(21) Appl. No.: 14/295,830

(22) Filed: Jun. 4, 2014

(65) Prior Publication Data

US 2015/0276139 A1 Oct. 1, 2015

Related U.S. Application Data

(63) Continuation-in-part of application No. 14/224,531, filed on Mar. 25, 2014.

(51) Int. Cl.
*F21V 19/00* (2006.01)
*F21K 99/00* (2016.01)
(Continued)

(52) U.S. Cl.
CPC ..... *F21K 9/175* (2013.01); *F21K 9/27* (2016.08); *F21V 19/003* (2013.01);
(Continued)

(58) Field of Classification Search
CPC ..... F21K 9/17–9/175; F21V 19/003; F21V 19/004
See application file for complete search history.

(56) References Cited

U.S. PATENT DOCUMENTS 5,688,042 A 11/1997 Madadi et al.
6,853,151 B2 2/2005 Leong et al.
(Continued)

FOREIGN PATENT DOCUMENTS

AT WO 2013072267 A1 * 5/2013 ..... F21V 17/164
JP H08162677 A 6/1996
(Continued)

OTHER PUBLICATIONS

U.S. Appl. No. 29/467,949, filed Sep. 25, 2013.
(Continued)

*Primary Examiner* — Andrew Coughlin
*Assistant Examiner* — Nathaniel Lee
(74) *Attorney, Agent, or Firm* — Dennis J. Williamson; Moore & Van Allen PLLC

(57) ABSTRACT

An enclosure is divided into first and second portions by a theoretical plane defined by a horizontal line. LEDs are mounted on an LED board in the enclosure and are operable to emit light when energized through an electrical path. A first pin is mounted to a first end of the enclosure and a second pin mounted to a second end of the enclosure, both pins being in the electrical path. Braces support the LED board and comprise first and second legs. The first leg and second leg extend to a first point and a second point of intersection of the plane and the internal surface of the enclosure, respectively. A first conductor connects the first pin to the LED board and a second conductor connects the second pin to the LED board. The first conductor and first pin and the second conductor and the second pin are one-piece.

18 Claims, 16 Drawing Sheets

(51) Int. Cl.

| | |
|---|---|
| ***F21K 9/27*** | (2016.01) |
| *F21V 17/16* | (2006.01) |
| *F21Y 103/10* | (2016.01) |
| *F21Y 115/10* | (2016.01) |

(52) U.S. Cl.
CPC ..... *F21V 19/004* (2013.01); *F21Y 2103/10* (2016.08); *F21Y 2115/10* (2016.08)

(56) References Cited

U.S. PATENT DOCUMENTS

| | | | |
|---|---|---|---|
| 6,860,628 | B2 | 3/2005 | Robertson et al. |
| 6,936,968 | B2 | 8/2005 | Cross et al. |
| 7,048,410 | B2 | 5/2006 | Kutler |
| 7,049,761 | B2 | 5/2006 | Timmermans et al. |
| 7,114,830 | B2 | 10/2006 | Robertson et al. |
| 7,307,391 | B2 | 12/2007 | Shan |
| 7,510,299 | B2 | 3/2009 | Timmermans et al. |
| 7,815,338 | B2 | 10/2010 | Siemiet et al. |
| 7,926,975 | B2 | 4/2011 | Siemiet et al. |
| 7,976,196 | B2 | 7/2011 | Ivey et al. |
| 8,058,659 | B2 | 11/2011 | Bisberg |
| 8,093,823 | B1 | 1/2012 | Ivey et al. |
| 8,115,411 | B2 | 2/2012 | Shan |
| 8,118,447 | B2 | 2/2012 | Simon et al. |
| 8,247,985 | B2 | 8/2012 | Timmermans et al. |
| 8,282,247 | B2 | 10/2012 | Ivey et al. |
| 8,324,817 | B2 | 12/2012 | Ivey et al. |
| 8,360,599 | B2 | 1/2013 | Ivey et al. |
| 8,362,710 | B2 | 1/2013 | Langovsky |
| 8,382,327 | B2 | 2/2013 | Timmermans et al. |
| 8,419,223 | B2 | 4/2013 | Withers |
| 8,421,366 | B2 | 4/2013 | Palazzolo et al. |
| 8,449,137 | B2 | 5/2013 | Dassanayake et al. |
| 8,482,212 | B1 | 7/2013 | Ivey et al. |
| 8,573,813 | B2 | 11/2013 | Ivey et al. |
| 8,596,813 | B2 | 12/2013 | Ivey |
| 8,888,306 | B2 | 11/2014 | Thomas et al. |
| 2002/0060526 | A1 | 5/2002 | Timmermans et al. |
| 2002/0114155 | A1 | 8/2002 | Katogi et al. |
| 2007/0183156 | A1* | 8/2007 | Shan ..... B60Q 1/2611 362/277 |
| 2010/0109501 | A1* | 5/2010 | Pei ..... H01R 4/06 313/51 |
| 2010/0328966 | A1* | 12/2010 | Shin ..... G02F 1/133605 362/609 |
| 2011/0117786 | A1* | 5/2011 | Takata ..... F21K 9/27 439/628 |
| 2012/0051041 | A1 | 3/2012 | Edmond et al. |

FOREIGN PATENT DOCUMENTS

| | | | | |
|---|---|---|---|---|
| JP | 2007059930 | A | 3/2007 | |
| JP | 2008288183 | A | 11/2008 | |
| JP | 2009117346 | A | 5/2009 | |
| JP | 3153766 | U | 9/2009 | |
| JP | 2009277586 | A | 11/2009 | |
| JP | 4755323 | B1 * | 8/2011 | ..... F21V 19/003 |
| WO | 2010099755 | A1 | 9/2010 | |

OTHER PUBLICATIONS

U.S. Appl. No. 13/943,152, filed Jul. 16, 2013.
U.S. Appl. No. 14/292,286, filed May 30, 2014.
U.S. Appl. No. 14/224,531, Office Action, Dec. 3, 2015.
U.S. Appl. No. 14/224,531, Final Office Action, Jun. 20, 2016.
U.S. Appl. No. 14/224,531, Office Action, Dec. 21, 2016.

* cited by examiner

LED LAMP WITH LED BOARD BRACE

This application is a continuation-in-part (CIP) of U.S. application Ser. No. 14/224,531, as filed on Mar. 25, 2014, now U.S. Publication No. US 2015/0276138, which is incorporated by reference herein in its entirety.

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

SUMMARY OF THE INVENTION

In some embodiments a LED lamp comprises an elongated at least partially optically transmissive enclosure having a first end and a second end. The enclosure comprises an internal surface having circular cross-section and is divided into a first half and a second half by a theoretical plane defined by a horizontal centerline. A LED is mounted on an LED board in the enclosure and is operable to emit light through the enclosure when energized through an electrical path. A first pin is mounted to the first end of the enclosure and a second pin mounted to the second end of the enclosure where the first pin and the second pin are in the electrical path. A plurality of braces are spaced along the length of the LED board and are mounted to the LED board. Each of the plurality of braces comprises a first leg having a first end and a second leg having a second end where the first end extends to a first point of intersection of the plane and the internal surface of the enclosure and the second end extends to a second point of intersection of the plane and the internal surface of the enclosure.

The centerline may be located at the horizontal diameter of the enclosure. The first leg and the second leg may be configured to define arcs of a circle such that outer surfaces of the first leg and the second leg are curved and have a radius that is approximately equal to the radius of the internal surface of the enclosure. The outer surfaces of the first leg and the second leg may abut the internal surface of the enclosure over the length of the first leg and the second leg. The internal surface of the enclosure may have a circumference and the circumferential distance between the end of the first leg and the end of the second leg may be approximately equal to one half the circumference. The internal surface of the enclosure may have a diameter and a linear distance between the end of the first leg and the end of the second leg may be approximately equal to the internal diameter of the enclosure. The end of the first leg and the end of the second leg may be at or near the plane defined by the centerline L-L. Each of the plurality of braces may comprise a channel for receiving the LED board. Each of the plurality of braces may comprise a first channel and a second channel for receiving opposite longitudinal edges of the LED board. The first leg and the second leg may be deformed by engagement with the enclosure. The plurality of braces may each comprise a first engagement member that engages a second engagement member on the LED board for fixing the position of the plurality of braces relative to the LED board. The plurality of braces may be formed of optically transmissive material. The plurality of braces may be clear. The LED board may provide physical support for the LED and may form part of the electrical path. A portion of the enclosure may extend behind the LED board. A width of the enclosure may be greater than a width of the LED board. A first end cap may support the first pin and a second end cap may support the second pin.

In some embodiments a lamp comprises an elongated at least partially optically transmissive enclosure having a first end and a second end. The enclosure comprises an internal surface having a cross-section and comprising a first portion and a second portion where the first portion is wider that the second portion. At least one LED is in the enclosure operable to emit light through the enclosure when energized through an electrical path. The at least one LED is mounted on an LED board. A first pin is mounted to the first end of the enclosure and a second pin is mounted to the second end of the enclosure where the first pin and the second pin are in the electrical path. At least one brace engages the LED board. The at least one brace is located in the first portion and comprises a first member comprising a first end and a second member comprising a second end where the first end and the second end extend to the second portion of the enclosure.

A plurality of braces may be spaced along the length of the LED board and engage the LED board. A theoretical plane may define the first portion and the second portion where the enclosure narrows from the theoretical plane toward the second portion. The first end and the second end may extend to the theoretical plane.

In some embodiments a lamp comprises an at least partially optically transmissive enclosure. At least one LED is in the enclosure and is operable to emit light through the enclosure when energized through an electrical path. The LED is mounted on an LED board. A first end cap is secured to the enclosure and supports a first pin and a second end cap is secured to the enclosure and supports a second pin where the first pin and the second pin are in the electrical path. A first conductor connects the first pin to the LED board using a first contact coupling and a second conductor connects the second pin to the LED board using a second contact coupling. The first conductor is formed as one piece with the first pin and the second conductor is formed as one-piece with the second pin.

The first conductor and the second conductor may be resilient. The LED board may comprise a first contact and a second contact and the first conductor and the second conductor may be deformed to create a bias force between the first conductor and the first contact and the second conductor and the second contact. A support surface may be positioned adjacent the LED board to a side of the LED board opposite the first conductor and the second conductor.

The first pin and the first conductor may be made of a first piece of electrically conductive material that is bent to form the first pin and the first conductor and the second pin and the second conductor may be made of a second piece of electrically conductive material that is bent to form the second pin and the second conductor. The first pin and first conductor and the second pin and the second conductor may be made of stainless steel. The first pin and the second pin may be hollow. The first pin and the first conductor may be retained in the first end cap by a deformable first tang and the second pin and the second conductor may be retained in the second end cap by a deformable second tang.

DETAILED DESCRIPTION

Figures 1, 2:
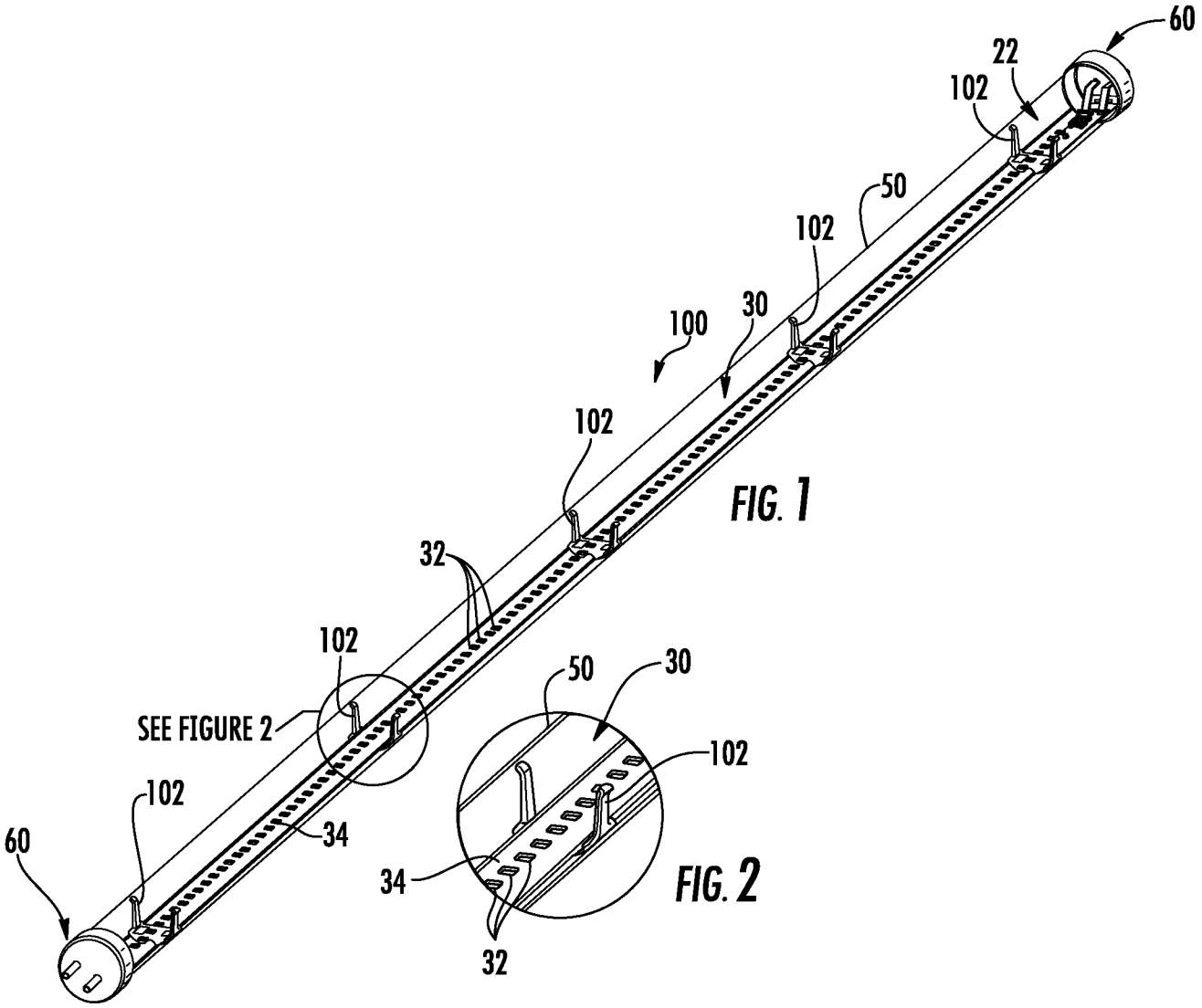
FIG. 1 is a perspective view showing an embodiment of a LED lamp of the invention.
FIG. 2 is a detailed perspective view of the LED lamp of FIG. 1.
Figure 3:
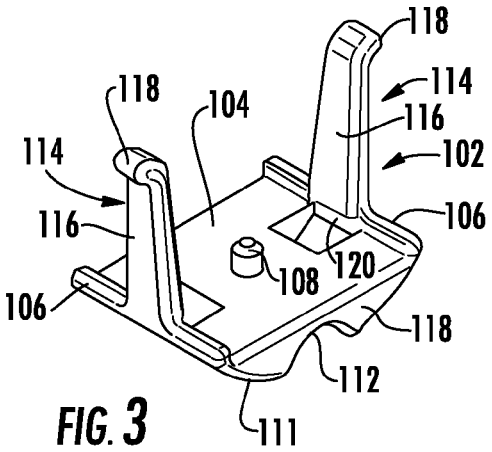
FIG. 3 is a perspective view of a brace usable in the LED lamp of FIG. 1.
Figure 4:
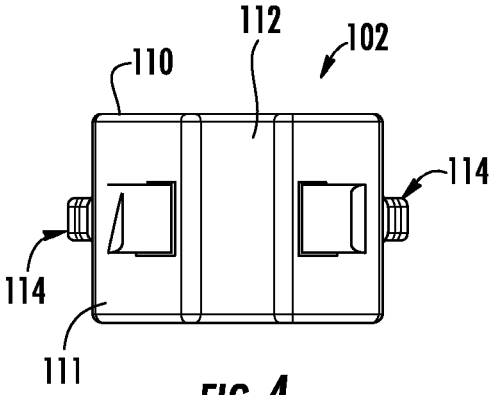
FIG. 4 is a bottom view of a brace usable in the LED lamp of FIG. 1.
Figure 5:
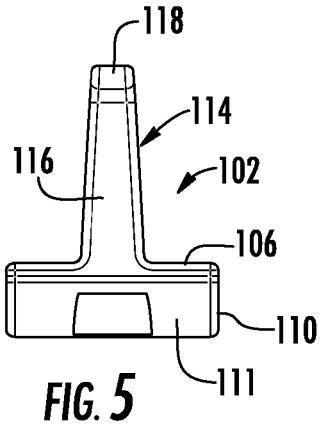
FIG. 5 is a side view of a brace usable in the LED lamp of FIG. 1.
Figure 6:
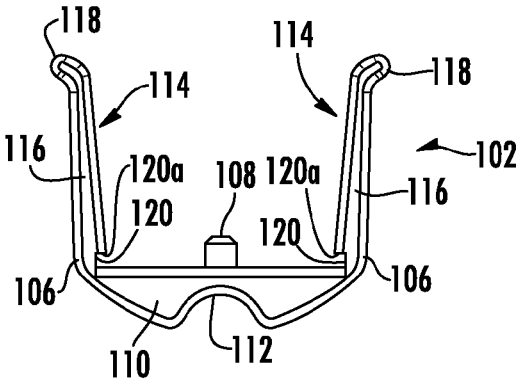
FIG. 6 is a front view of a brace usable in the LED lamp of FIG. 1.
Figure 7:
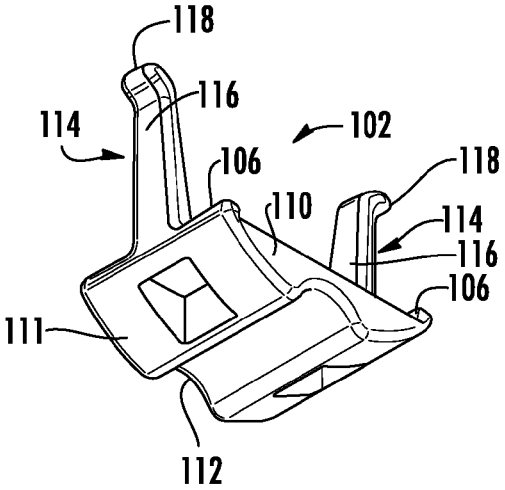
FIG. 7 is another perspective view of a brace usable in the LED lamp of FIG. 1.
Figure 8:
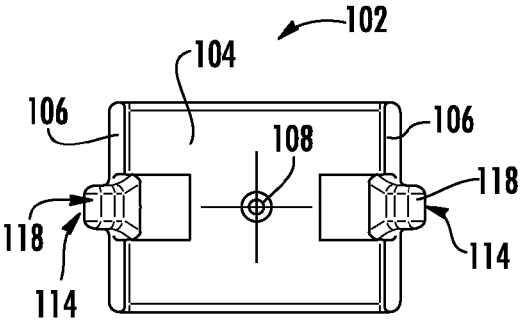
FIG. 8 is a top view of a brace usable in the LED lamp of FIG. 1.
Figure 9:
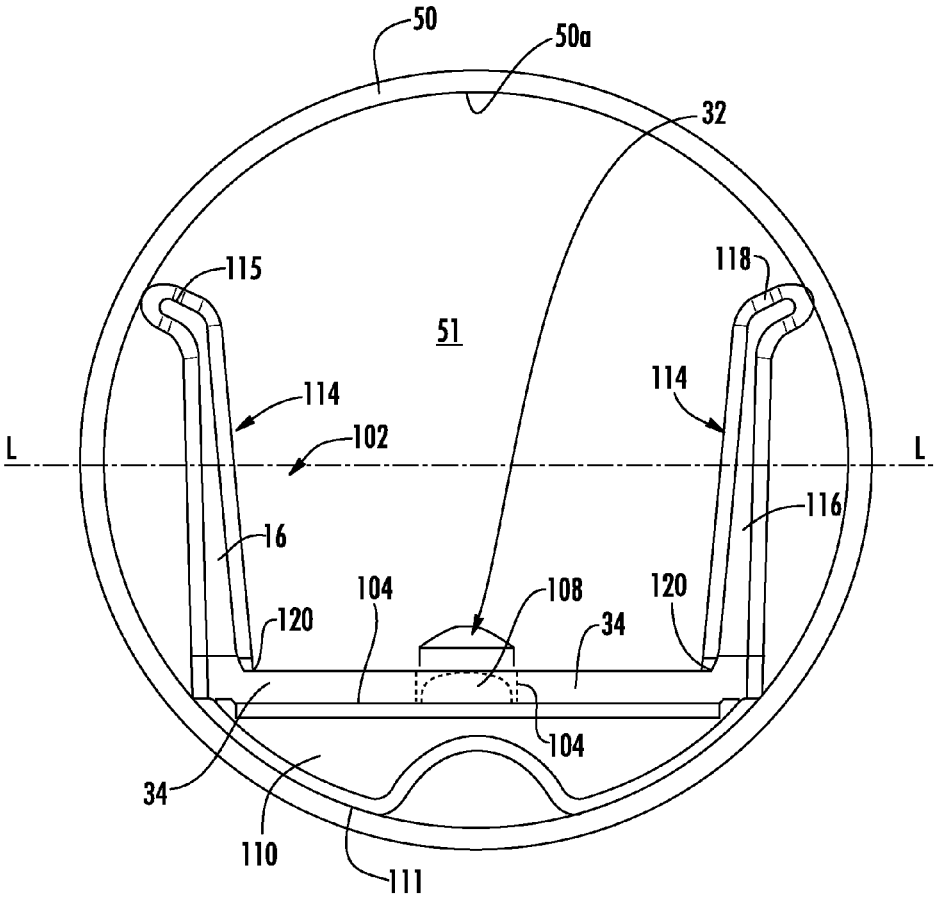
FIG. 9 is a detailed end view of the brace of FIG. 3 in the LED lamp of the invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

Because LED based solid state lamps use less energy, are more durable, operate longer, can be combined in multicolor arrays that can be controlled to deliver virtually any color light, and generally contain no lead or mercury the conversion to, or replacement of fluorescent lighting systems with, LED lighting systems is desired. In some existing replacement lamps the entire fluorescent fixture including the troffer must be replaced. The conversion from a fluorescent light to a solid state LED based light may be time consuming and expensive. In the system of the invention, a traditional fluorescent light may be converted to an LED based solid state lamp quickly and easily by replacing the fluorescent bulb with an LED lamp. The LED lamp fits into the same housing as the fluorescent tube and uses the existing tombstone connectors to provide current to the LED lamp. The LED lamp of the invention allows a traditional fluorescent light to be converted to a solid state LED lamp without requiring specialized tools, equipment or training.

Referring to FIGS. 1-9 the LED lamp 100 comprises an LED assembly 30 that may be supported by and secured within the enclosure 50. The LED assembly 30 may comprise a plurality of LEDs or LED packages 32 that extend the length of, or substantially the length of, the lamp 100 to create a desired light pattern. The LEDs 32 may be arranged such that the light pattern extends the length of, or for a substantial portion of the length of, the lamp 100. While in one embodiment the LEDs 32 extend for substantially the entire length of the lamp, the LEDs 32 may be arranged in other patterns and may extend for less than substantially the entire length of the lamp and may positioned other than down the center of the LED board if desired. For example, the LEDs may be disposed along the edges of the LED board 34 and directed toward the middle of the lamp. The LEDs may be directed into a waveguide.

The LEDs 32 may be mounted on a LED board 34 that provides physical support for the LEDs 32 and provides an electrical path for providing electrical power to the LEDs. The electrical path provides power to the LEDs and may comprise the power source, LED board 34 and intervening lamp electronics 22. The LED board 34 may comprise a PCB using a thin FR4 or a flex circuit. In other embodiments the LED board 34 may comprise a MCPCB, PCB, or lead frame structure. The LED board 34 provides a mounting substrate for the LEDs. The LED board 34 may comprise the electrical components such as a copper layer, traces or the like that form part of the electrical path to the LEDs 32. In other embodiments the electrical conductors to the LEDs 32 may comprise separate conductive elements. In one embodiment the LED board 34 comprises a thermally conductive material, such as a metal layer such as copper, such that heat generated by the LED may be dissipated to the air in the enclosure 50 and be dissipated to the ambient environment by the enclosure 50. In some embodiments the LEDs may be operated at low current and the conductive metal layer of the LED board may be thermally exposed to dissipate enough heat from the LEDs that a heat sink structure is not required. Thermally exposed means that the metal layer is thermally conductive with the air in the enclosure although it may be covered by a thin paint layer or solder mask. The copper, or other metal, layer is thermally exposed in that the cover coat layer is not thermally insulating and heat may be transferred from the copper layer to the surrounding air. In some embodiments, the LED board 34 may comprise more than one physical board where the boards are connected to one another at a connector to provide an electrical path between the individual boards.

The LED board 34 may comprise a flex circuit comprising a flexible layer of a dielectric material such as a polyimide, polyester or other material to which a layer of copper or other electrically conductive material is applied such as by adhesive. Electrical traces are formed in the copper layer to form electrical pads for mounting the electrical components such as LEDs 10 and lamp electronics 22 on the flex circuit and for creating the electrical path between the components. In other embodiments the substrate 20 may comprise a PCB such a PCB FR4 board. A PCB FR4 board comprises a thin layer of copper foil laminated to one side, or both sides, of an FR4 glass epoxy panel. The FR4 copper-clad sheets comprise circuitry etched into copper layers to make the PCB FR4 board. In both the PCB FR4 board and the flex circuit the copper metal layer is supported on a low thermally conductive layer, either a glass epoxy panel or a polyimide layer, where the LEDs are mounted in the enclosure on the LED board without a heat sink.

In some embodiments the LED board 34 may be supported on a separate support member where the support member may be made of a rigid, thermally conductive material such as aluminum that physically supports the LED board. While aluminum may be used, other rigid, thermally conductive materials may be used to form the support member. The LED board 34 may be secured to the support member such as by adhesive, fasteners or the like. While in some embodiments a support member may be used, in other embodiments the LED board 34 may be used without an additional support member. In some embodiments the support member may be made of a thermally conductive material to dissipate heat from the LEDs to the air in the enclosure 50. In some embodiments thermally conductive layers may be provided between the support member and the LED board. For example, thermal adhesive may be used to attach the LED board 34 to the support member. While an additional support member may be used, in some embodiments the LEDs are supported only on the LED board 34 where the LEDs are operated such that sufficient heat is dissipated from the LED board 34 using only the metal in the LED board to achieve steady state operation.

The LEDs 32 may be provided in a wide variety of patterns and may include a wide variety of different types and colors of LEDs to produce light in a wide variety of colors and/or light patterns. One embodiment of a LED lamp and suitable LED structure is shown and described in U.S. patent application Ser. No. 12/873,303 entitled "Troffer-Style Fixture" filed on Aug. 31, 2010, which is incorporated by reference herein in its entirety.

The LED board 34 may be mounted in the enclosure 50. The enclosure 50 is at least partially optically transmissive such that light emitted from the LEDs 32 is transmitted through the enclosure 50 to the exterior of the lamp. In some embodiments the enclosure 50 is entirely optically transmissive such that light may be emitted from the enclosure over 360 degrees. The enclosure 50 creates a mixing chamber 51 for the light emitted from the LEDs 32 and acts as a lens for the light emitted from the lamp. The light is mixed in the chamber 51 and the optically transmissive enclosure 50 may diffuse the light to provide a uniform, diffuse, color mixed light pattern. The enclosure 50 may be made of extruded plastic, glass or other optically transmissive material and may be provided with a light diffuser. The light diffuser may be provided by etching, application of a coating or film, by the translucent or semitransparent material of the enclosure material, by forming an irregular surface pattern during formation of the lens or by other methods. In the illustrated embodiments the enclosure is shown as clear in order to show the internal components of the lamp; however, the enclosure may comprise a diffuser such that in actual use the internal components may not be visible or may only be partially visible. In other embodiments a first portion of the enclosure may be optically transmissive and a second portion of the enclosure may be optically non-transmissive, such as a reflective surface. In such an embodiment the front of the enclosure 50 may be optically transmissive and the back of the enclosure 50 may be optically non-transmissive such that the back of the enclosure reflects light toward the front of the enclosure.

To facilitate the explanation of the structure of the lamp, the side of the lamp behind the LEDs 32 is referred to as the back of the lamp and the side of the lamp facing the LEDs 32 is referred to as the front of the lamp. In the drawings the bottom portion of the lamp is the back of the lamp and the top portion of the lamp is the front of the lamp. The lamp is shown in the drawings with the LEDs 32 facing upward, but in a typical use the lamp is located in a ceiling fixture where the LEDs 32 face downward. Thus, in a typical use the front of the lamp faces outwardly and downwardly from the fixture and the back of the lamp faces inwardly and upwardly.

In one embodiment the enclosure 50 may be formed as a tube with a cylindrical outer surface and a generally cylindrical inner surface 50*a* having a round cross-section. The enclosure 50 may have the elongated form factor of a traditional fluorescent tube where the length of the lamp is significantly greater than its diameter. Because the lamp of the invention is intended to be used as a replacement for traditional fluorescent tubes the length of the lamp 100 of the invention may also be dimensioned to fit standard fluorescent bulb housings such that the lamp 100 extends between the tombstone connectors of a traditional fixture with the pins 94 extending parallel to the longitudinal axis of the lamp. In some embodiments, where the lamp 100 of the invention is used to replace a standard 1 inch fluorescent tube the lamp of the invention may have a diameter of approximately 1 inch. The lamp may also be dimensioned to fit into existing fluorescent housings or fixtures such that the lamp may be made is standard lengths such as 48 inches, 24 inches or the like. While the enclosure is shown as being cylindrical the enclosure may have other shapes and sizes. The enclosure 50 extends substantially the length of the LED assembly 30 to cover the LEDs 32 supported on the LED board 34.

As illustrated in the figures the LED board 34 is arranged in the enclosure 50 such that it is positioned offset from the horizontal centerline of the enclosure 50 such that the LED board is disposed closer to the back of the enclosure 50 than the front of the enclosure. The horizontal centerline L-L is a theoretical plane that is at the center or diameter of the enclosure 50 and that is parallel to the LED board 34. Locating the LED board 34 offset from the centerline L-L of the enclosure 50, provides a larger mixing chamber in front of the LEDs and provides for more backlight. The enclosure 50 is arranged such that to the lateral sides of the LEDs 32 there is no structure to block light emitted by the LEDs. In some embodiments the longitudinal edges of the LED board 34 engage the sides of the enclosure 50. The planar LED board 34 does not obstruct light emitted laterally from the LEDs 32. The enclosure 50, in some embodiments, may be configured such that the width of the enclosure 50 at its widest portion is greater than the width of the LED board 34. As a result, light may be emitted from the enclosure 50 as backlight that is not blocked by the LED board 34. As a result of this arrangement some of the light generated by the LEDs 32 is directed as backlight in a direction behind the plane of the LEDs 32. Some of the light emitted by the LEDs may be emitted directly as backlight while other light emitted by the LEDs may be reflected off of the enclosure 50 and emitted as backlight. The backlight creates a light distribution pattern that is similar to the light distribution pattern of a traditional fluorescent tube. It will be understood that in a traditional fluorescent system the fluorescent tube generates light over 360 degrees. As a result, some of the light generated by the fluorescent tube is reflected from the fixture housing. The backlight generated by the LEDs 32 may be directed toward and reflected from the fixture housing such that the LED lamp of the invention provides a visual appearance similar to the of a fluorescent tube. Such an arrangement provides an LED lighting system that provides a light distribution pattern that is similar to legacy fluorescent tube lights. In some embodiments, the LEDs may be center mounted with greater side emitting optical profiles such as CREE XPQ LEDs. In some embodiments a prismatic lens or parabolic reflectors may be used to create a desired light distribution. Further, combinations of different types of LEDs may be used to create a variety of light patterns and intensities.

Referring to FIGS. 1-9, discrete LED board braces 102 align and mount the LED board 34 in the enclosure 50. In one embodiment the braces 102 are fixed to the LED board 34 and engage the interior surface 50*a* of the enclosure 50 such that the LED board 34 may be supported the braces 102 in a desired position in the enclosure 50. The braces 102 may be connected to the LED board 34 and inserted into the enclosure 50 with the LED board 34 such that the braces 102 are located at spaced locations along the length of the enclosure 50. The number of braces 102 and the spacing between the braces may be determined by the relative flexibility of the LED board 34, the length of the lamp and the amount of support the LED board 34 requires to prevent sagging or flexing of the LED board.

In one embodiment, the braces 102 may be made of an optically transmissive material such that light may be transmitted through the braces. The braces 102 may be made of the same optically transmissive material as the enclosure 50 such as polycarbonate. While in one embodiment the braces 102 and the enclosure 50 are made of the same optically transmissive material, in some embodiments the braces 102 and the enclosure 50 may be made of different optically transmissive materials. For example the enclosure 50 may be made of glass and the braces 102 may be made of clear plastic. The braces 102 may be made of clear plastic, diffusive plastic or other optically transmissive material. By making the braces 102 of optically transmissive material the braces 102 transmit light such that the braces do not block light emitted by the LEDs 32 and are not visible or are only slightly visible during operation of the lamp. In other embodiments the braces 102 may be made of or covered in a reflective material such that the braces 102 reflect light emitted by the LEDs 32. For example the braces 102 may be made of white optic plastic, PET, MCPET or the like. Alternatively the braces 102 may be covered in a reflective layer such as aluminum or the like. In one embodiment the braces 102 may be molded of plastic such that the braces 102 may be made at low cost and with minimal material or processing steps.

In one embodiment each brace 102 comprises a mounting surface 104 that abuts or faces the back of the LED board 34. Because the typical LED board 34 is a generally planar member having a relatively flat back side, the mounting surface 104 typically comprises a planar member. Where the LED board 34 is formed with other than a flat back side, the mounting surface 104 may be provided with a complimentary shape such that the mounting surface 104 is able to receive the LED board 34. The mounting surface 104 may terminate in a flange 106 along either edge thereof where the width of the mounting surface 104 between the flanges 106 is approximately the same or slightly greater than the width of the LED board 34. The LED board 34 may be placed on the mounting surface 104 such that the longitudinal edges of the LED board 34 are constrained between the flanges 106.

An engagement member 108, such as a pin, may extend from the mounting surface 104 that is configured to engage a mating engagement member 109, such as an aperture, on the LED board 34. The engagement of the pin 108 with the aperture 109 on the LED board fixes the position of the brace 102 relative to the LED board 34 such that the LED board is constrained from moving relative to the brace. In one embodiment a single generally cylindrical pin 108 is located in the center of the mounting surface 104; however, the pin 108 may have any shape and size provided it can engage a corresponding aperture on the LED board 34. Moreover, more than one pin may be used on each brace 102. The engagement members may be reversed such that the LED board 34 may be formed with a pin or other male engagement member and the mounting surface 104 may be provided with a mating aperture or other female engagement member. While the brace 102, as shown in the drawings, is formed as one-piece with the pin, a separate engagement member may be provided where, for example, both the LED board 34 and the brace 102 are provided with apertures and a separate pin or other engagement member is inserted into the apertures on both the LED board 34 and the brace 102.

A base 110 is formed on the back side of the brace 102 that is configured to position the mounting surface 104 at the desired height in the enclosure 50. The base 110 may be configured such that is abuts and conforms to the inside surface 50*a* of the enclosure 50 over a portion of the circumference of the enclosure. Where, as described herein, the enclosure 50 comprises a tube that has a size and shape similar to a traditional fluorescent tube, the base 110 is formed as a segment of a cylinder where the outer wall 111 of the base 110 fits into and engages the internal surface 50*a* of the enclosure 50. The radius of the outer wall 111 of the base 110 is approximately the same, or slightly smaller than, the radius of the interior surface 50*a* of the enclosure 50. Where the enclosure 50 has a shape other than a tube the base 110 may be formed with a complimentary shape. In one embodiment the base 110 has a thinned center area 112 to minimize the amount of material used. The thinned area 112 may also allow the base 110 to flex slightly when the LED board 34 is inserted into the brace 102 and/or when the support is inserted into the enclosure 50.

A member such as a leg 114 extends from the base 112 at each side of the mounting surface 104. Each leg 114 may have an upright 116 that extends generally perpendicularly from the mounting surface 104 and a projection or flared toe 118 that extends away from the upright 116 toward the outside of the brace 102. The legs 114 are configured such that when the brace 102 is inserted into the enclosure 50 the projections 118 contact the interior surface 50*a* of the enclosure 50 such that the legs 114 form a point contact with the enclosure 50 and block as little light as possible from exiting the enclosure 50. The legs 114 may be slightly deformed inwardly when the brace 102 is mounted in the enclosure 50 such that the legs 114 are biased to exert a slight force on the enclosure 50 that maintains the outer wall 111 of the base 110 against the enclosure 50. The brace 102 may be made of a resilient material such that when the legs 114 are deformed the legs create the bias force.

A channel 120 is formed near the bottom of each of the legs 114 coextensive with the mounting surface 104. The channels 120 are dimensioned to receive lateral edges of the LED board 34 when the LED board 34 is mounted on the brace 102. While the channels 120 are formed at the bottom of the legs 114 the channels 120 may be formed anywhere along the edges of the mounting surface 104, for example, as part of flanges 106. The brace 102 may be made of a resilient material such as plastic such that the legs 114 and/or base 110 may be slightly deformed to allow the longitudinal edges of the LED board 34 to be inserted into the channels 120. Moreover, some LED boards such as a PCB with FR4 and flex circuit are also slightly deformable such that the LED board 34 may also be slightly deformed as it is inserted into the channels 120. Once the LED board 34 is inserted into the channels 120 the front surfaces 120*a* of the channels 120 abut or are in close proximity to the front surface of the LED board 34 such that the LED board is supported by the surfaces 120*a* during use of the lamp and the LED board 34 cannot be removed from the brace 102 without deforming the brace 102 and/or the LED board 34. Because the legs 114 are biased against the interior wall 50*a* of the enclosure 50 and the base 110 abuts the interior wall 50*a* as previously described the brace 102 cannot be deformed to release the LED board 34 once the brace 102 and LED board 34 are mounted in the enclosure 50. The channels 120 may be dimensioned and configured to closely receive the LED board such that the LED board is held under slight pressure and/or a friction fit in the channels 120.

While a brace 102 having two legs 114 is shown, the brace 102 may comprise multiple legs on each side of the mounting surface 104. Moreover, the legs 114 can have a shape that is different from that shown in the drawings. Numerous other changes in the relative sizes and shapes of the components of the support may also be made.

The braces 102 may extend for any portion of the length of the LED board 34 provided that the braces 102 support and align the LED board 34 in the enclosure 50. In some embodiments each brace 102 may extend for approximately one inch and be spaced approximately 12 inches from one another. In some embodiments 4 or 5 braces may be used in a 48 inch lamp to support a LED board such as a PCB FR4 board. However, the braces 102 may be longer or shorter and may be spaced closer together or farther apart depending upon the amount of support needed by the LED board 34. A more flexible LED board may use longer braces, more braces and/or space the braces closer together while a more rigid LED board may use fewer braces, smaller braces and/or space the braces farther apart. In one embodiment the brace 102 may extend for the entire length of the enclosure 50 such that the LED board is supported over its entire length; however, using fewer and smaller braces results in a lower cost and lighter lamp. Moreover, using relatively small braces spaced from one another along the length of the lamp also provides a safety feature. In the event the lamp structurally fails, e.g. the enclosure 50 is broken, live electrical components in the lamp must be physically isolated or the lamp must be unable to be connected to a fixture that provides a source of power. In a fluorescent style lamp, if the enclosure 50 breaks, the lamp is physically unable to be mounted in a fixture. By using small braces that are relatively widely spaced from one another, a break of the enclosure 50 will cause a catastrophic failure of the lamp such that it cannot be installed in a fixture, thereby satisfying safety requirements. If a brace is used that extends the length of the lamp, the possibility exists that the brace 102 will retain enough structural integrity that a broken lamp may be able to be mounted in a fixture. Using the small, spaced braces as described herein eliminates this possibility. With a plastic enclosure or a shatterproof glass enclosure the safety requirements are satisfied because the enclosure cannot shatter to expose live electrical components. In such an embodiment the length of the brace does not create a problem such that in a plastic or shatter resistant glass enclosure, for example, providing a brace that extends the length of the enclosure may be used to help to reinforce and stiffen the lamp. In a breakable enclosure a brace that extends the length of the enclosure may be used provided that the live electrical components are otherwise isolated.

In use the lamp is typically supported with the LEDs facing downward (for example, as viewed with FIG. 9 turned upside down) such that the LED board 34 rests on and is supported by the surfaces 120*a* of channels 120. The LED board 34 may also be supported by the engagement of the pins 108 with the apertures 110. The apertures 110 and pins 108 may be configured such that a relatively tight friction fit and/or mechanical engagement is created between the LED board and the pins. Also, in this position the legs 114 of the brace 102 engage the interior surface 50*a* of the enclosure 50 to support the channels 120 in the proper vertical position relative to the enclosure. The braces 112 support the LED assembly inside of the enclosure 50 without the braces being attached to the enclosure. The brace 112 is held in position by the contact of the legs 114 and base 110 with the interior surface 50*a* of the enclosure 50 but no mechanical or adhesive attachment mechanism is required. Such a mounting arrangement is referred to herein as a "contact mount" as distinguished from an attached mount that uses an attachment mechanism such as adhesive, epoxy, mechanical fasteners or the like.

Figure 10:
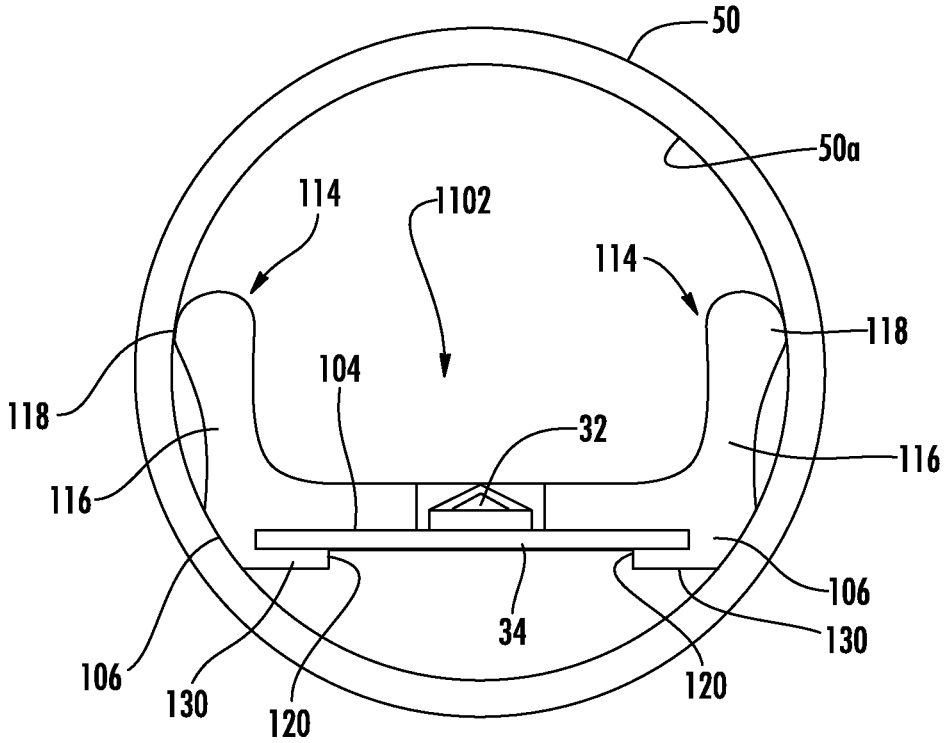
FIG. 10 is a detailed end view of another embodiment of a brace in the LED lamp of the invention.

FIG. 10 shows an alternate embodiment of the brace where like reference numbers are used to identify like components previously described with reference to the embodiments of FIGS. 1-9. In the embodiment of FIG. 10 the brace 1102 comprises a mounting surface 104 that is disposed across the front of the LED board 34 rather than across the back of the LED board. The mounting surface 104 may include a pin or other engagement structure (not shown) that engages a hole or other engagement structure on the LED board to fix the position of the LED board relative to the brace 1102 as previously described. A leg 114 extends from each side of the mounting surface 104. The legs 114 may have an upright portion 116 that extends generally perpendicularly from the mounting surface 104 and a flared toe or projection 118 that extends away from the uprights toward the outside of the support. The legs 114 are configured such that when the brace 1102 is inserted into the enclosure 50 the projections 118 contact the interior wall 50*a* of the enclosure 50 and the legs 114 are deformed or biased slightly inwardly as previously described. The back side of the brace 1102 is not provided with a base as in the embodiment of FIG. 9, rather the back side of the brace 1102 defines the channels 120 for receiving the LED board 34. A pair of flanges 106 extend along the lateral edges of the mounting surface 104 that include lips 130 that together define channels 120 for receiving the longitudinal edges of the LED board 34. The channels 120 hold the LED board 34 against the mounting surface 104. The LED board 34 is supported on the mounting surface 104 rather than being supported on the surfaces 120*a* of the channels as in the embodiment of FIGS. 1-9. The legs 114 engage the interior surface 50*a* of enclosure 50 to support the LEDs 32 at the desired height in the enclosure 50 using a contact mount as previously described.

Figure 11:
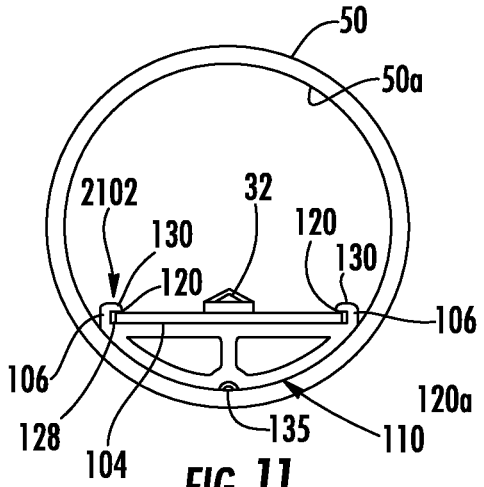
FIG. 11 is a detailed end view of another embodiment of a brace in the LED lamp of the invention.
Figure 12:
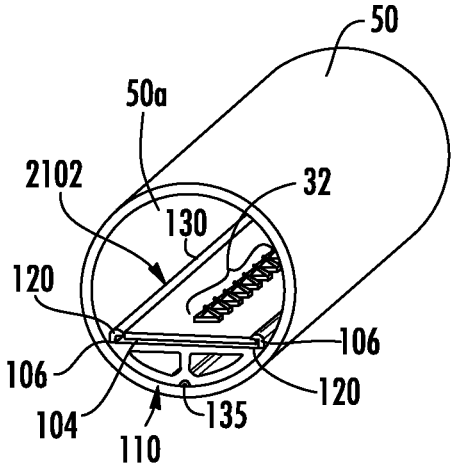
FIG. 12 is a partial perspective view of the LED lamp of the invention and the brace of FIG. 11.

Another embodiment of the brace 2102 is shown in FIGS. 11 and 12 and comprises a mounting surface 104 for receiving the LED board. A pair of flanges 106 extend along the lateral edges of the mounting surface 104 that include lips 130 that together define channels 120 for receiving the longitudinal edges of the LED board 34. The LED board 34 is retained in the channels 120 where the LED board rests on surfaces 120*a* during typical use of the lamp. The mounting surface 104 may include a pin or other engagement structure (not shown) that engages a hole or other engagement structure on the LED board to fix the position of the LED board relative to the support as previously described. A base 110 is configured to attach to the interior wall 50*a* of the enclosure 50 to support the mounting surface at the desired position in the enclosure. The base 110 abuts the enclosure to support the mounting surface 104 and LEDs 32 at the desired position in the enclosure 50. The base 110 may be configured such that is abuts the inside surface 50*a* of the enclosure 50 over a portion of the circumference of the enclosure. Where, as described herein, the enclosure 50 comprises a tube that has a size and shape similar to a traditional fluorescent tube, the base 110 may be formed as a segment of a cylinder where the base fits into the internal diameter of the tube. Where the enclosure 50 has a shape other than a cylinder the base 110 may be formed with a complimentary shape. Because the brace 2102 does not include the support legs 114, a separate attachment mechanism may be used. Adhesive 135 may be used to secure the brace 2102 to the enclosure. In one embodiment a bead of adhesive 135 may be applied to the interior surface 50*a* of the enclosure 50 and the brace 2102 may be positioned against the adhesive 130 to secure the brace 2102 to the enclosure 50. The brace 2102 may be attached to the enclosure 50 by any suitable attachment mechanism including adhesive, epoxy, mechanical fasteners, a snap-fit connection or the like. FIG. 12 shows a brace 2102 that is relatively longer than the brace 102 of FIGS. 1-9. The brace 2102 may extend the length of the enclosure or for relatively short segments as previously described.

Figure 13:
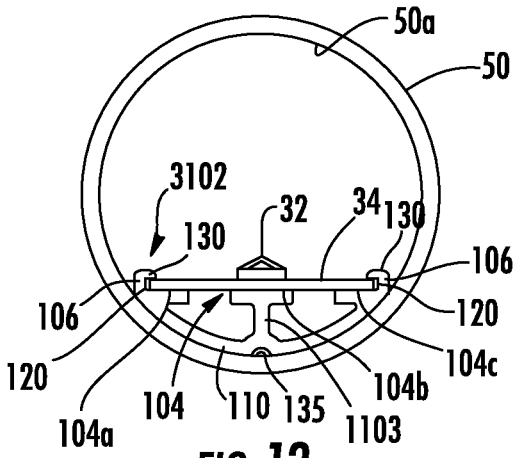
FIG. 13 is a detailed end view of another embodiment of a brace in the LED lamp of the invention.
Figure 14:
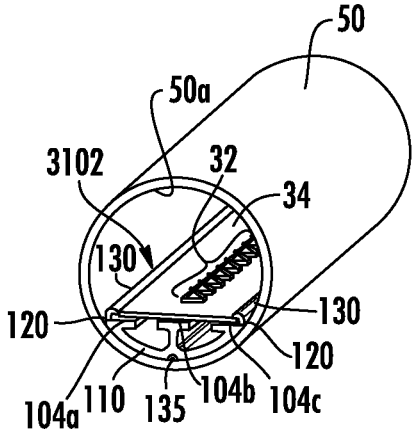
FIG. 14 is a partial perspective view of the LED lamp of the invention and the brace of FIG. 13.

FIGS. 13 and 14 show another embodiment of the brace of the invention. The brace 3102 of FIGS. 13 and 14 is similar to the brace 2102 of FIGS. 11 and 12 except that the mounting surface 104 is formed by three separate surfaces 104*a*, 104*b*, and 104*c* rather a single surface. The center surface 104*b* is connected to a center support 1103 that extends from the center of the base 110 and the two end surfaces 104*a* and 104*c* are connected to the ends of the base 110 to support the longitudinal edges of the LED board 34. Flanges 106 extends along the outside lateral edges of the mounting surfaces 104*a* and 104*c* that terminate in lips 130 that with the flanges 106 define channels 120 for receiving the longitudinal edges of the LED board 34. The LED board is trapped in the channels 120. The mounting surface 104 may include a pin or other engagement structure (not shown) that engages a hole or other engagement structure on the LED board to fix the position of the LED board relative to the support as previously described. The base 110 abuts the enclosure 50 to support the mounting surface 104 and LEDs 32 at the desired position in the enclosure 50. The base 110 may be configured such that is abuts the inside surface 50*a* of the enclosure 50 over a portion of the circumference of the enclosure. Where, as described herein, the enclosure 50 comprises a tube that has a size and shape similar to a traditional fluorescent tube the base 110 may be formed as a segment of a cylinder where the base fits into the internal diameter of the tube. Where the enclosure 50 has a shape other than a cylinder the base 110 may be formed with a complimentary shape. Because the brace 3102 does not include the support legs 114, a separate attachment mechanism may be used. Adhesive may be used to secure the brace 3102 to the enclosure. In one embodiment a bead of adhesive 135 may be applied to the interior surface 50*a* of the enclosure 50 and the brace 3102 may be positioned against the adhesive 130 to secure the brace to the enclosure. The brace 3102 may be attached to the enclosure 50 by any suitable attachment mechanism including adhesive, epoxy, mechanical fasteners, a snap-fit connection or the like. FIG. 14 shows a brace 3102 that is relatively longer than the brace 102 of FIGS. 1-9. The brace may extend the length of the enclosure or for relatively short segments as previously described.

Figure 17:
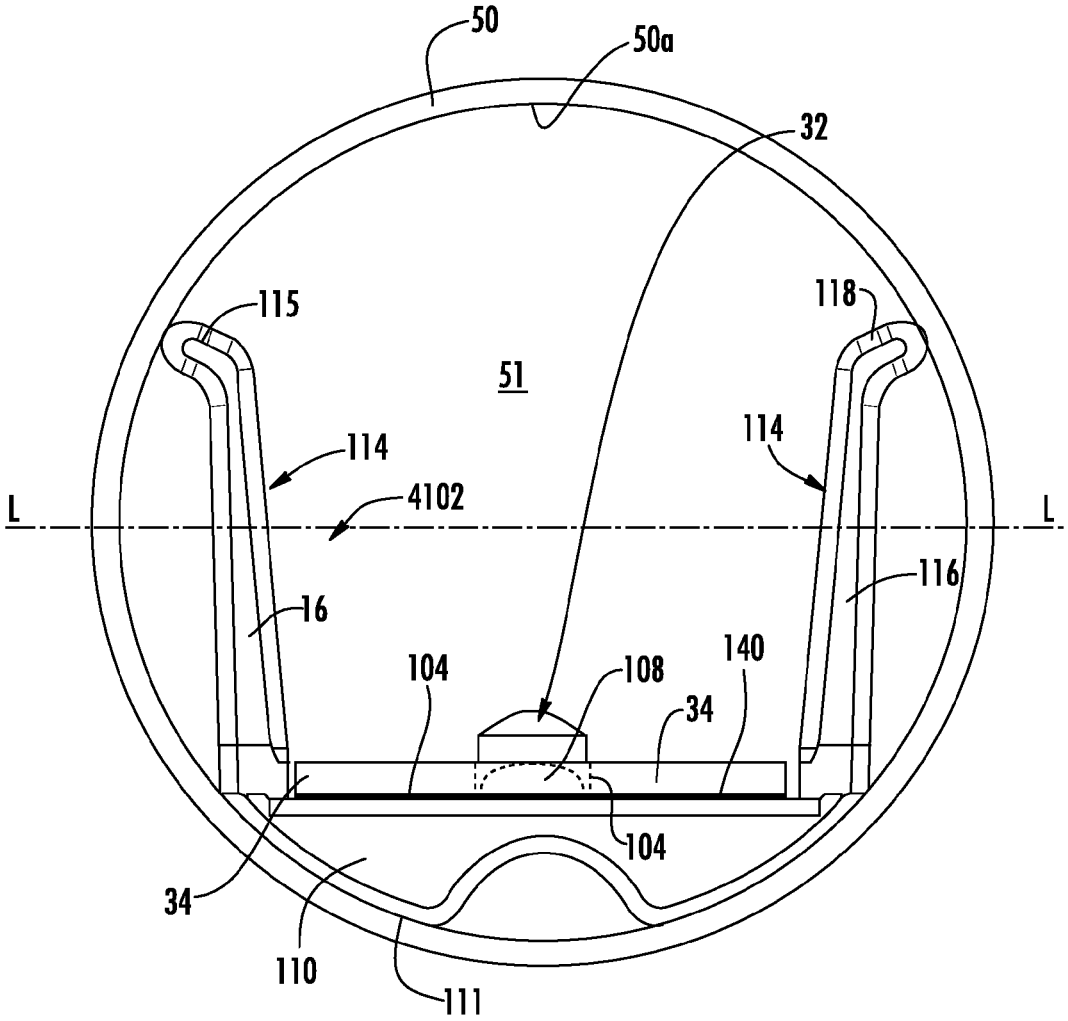
FIGS. 17, 18 and 19 are detailed end views of other embodiments of a brace in the LED lamp of the invention.
Figure 18:
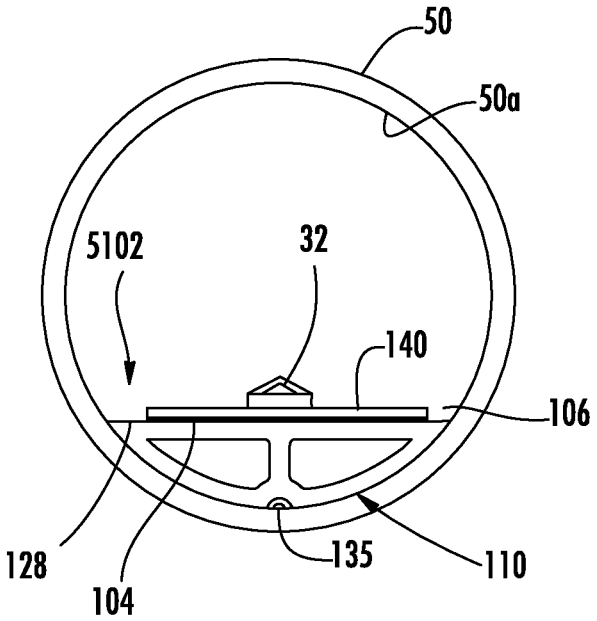
Figure 19:
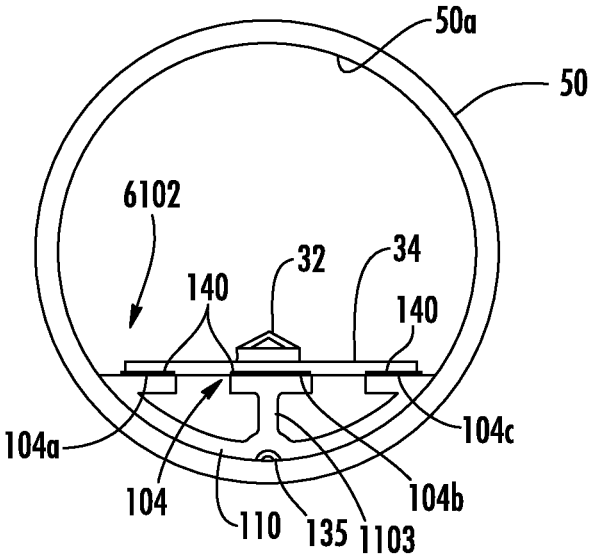
Figure 20:
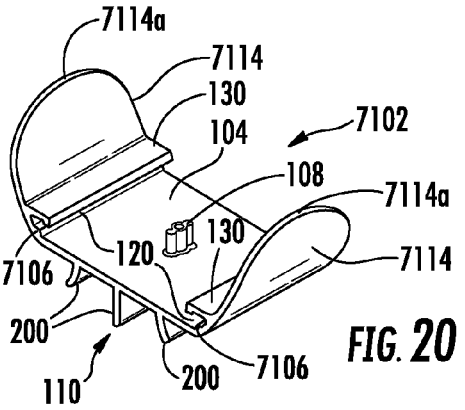
FIG. 20 is a perspective view of another embodiment of a brace usable in the LED lamp of FIG. 1.
Figure 21:
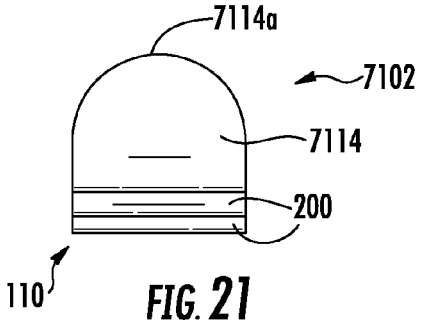
FIG. 21 is a side view of the brace of FIG. 20.
Figure 22:
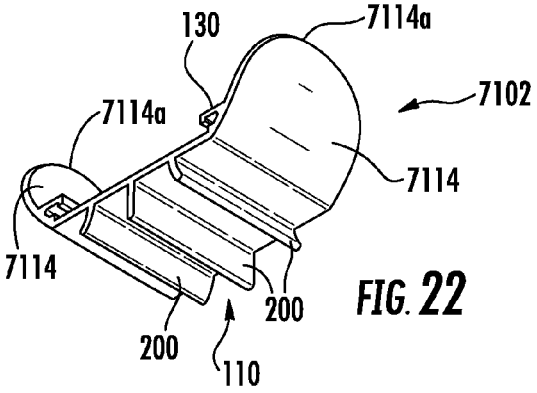
FIG. 22 is a bottom perspective view of the brace of FIG. 20.
Figure 23:
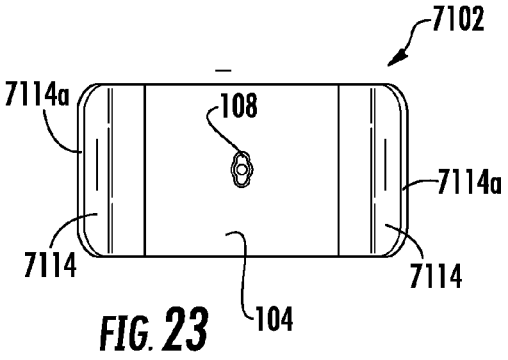
FIG. 23 is a top view of the brace of FIG. 20.
Figure 24:
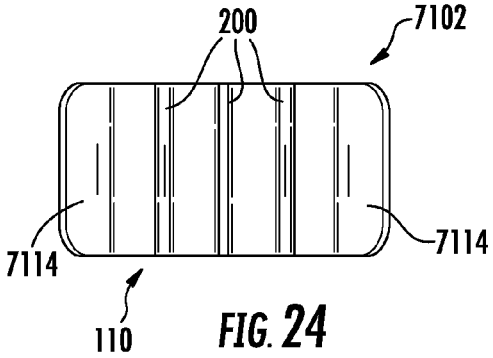
FIG. 24 is a bottom view of the brace of FIG. 20.
Figure 25:
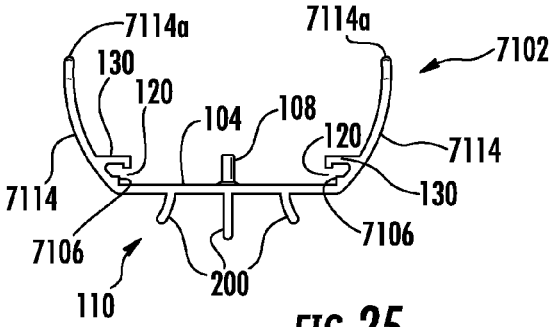
FIG. 25 is a front view of the brace of FIG. 20.

FIGS. 17, 18 and 19 show alternate embodiments of the brace of the invention. The brace 4102 is similar to the brace 102 of FIG. 9, the brace 5102 is similar to the brace 2102 of FIG. 11 and the brace 6102 of FIG. 19 is similar to the brace 3102 of FIG. 14 where like reference numerals are used to identify like components previously described with respect to the prior embodiments. In the embodiments of FIGS. 17, 18 and 19 the channels are removed and the LED board 34 is attached to the braces 4102, 5102 and 6102 by adhesive, epoxy, or other similar adherent 140.

In one embodiment, to assemble the LED board 34 and enclosure 50 at least one and typically a plurality of braces 102, 1102 are attached to the LED board 34 as previously described. The number of braces used and the spacing between the braces may be determined by the flexibility of the LED board, the length of the enclosure and the amount of support the LED board requires. The LED board 34 having the braces mounted thereon is inserted into the enclosure 50 from one end of the enclosure. The legs 114 on the braces may be compressed slightly by the enclosure 50 as previously described. The braces support the LED board 34 in position relative to the enclosure 50 as they are inserted into the enclosure and support and align the LED board 34 during operation and use of the lamp.

Another embodiment of the brace is shown in FIGS. 20-26. In this embodiment the braces 7102 are made of an optically transmissive material such that light may be transmitted through the braces. The braces 7102 may be made of the same optically transmissive material as the enclosure 50 such as polycarbonate. While in one embodiment the braces 102 and the enclosure 50 are made of the same optically transmissive material, in some embodiments the braces 7102 and the enclosure 50 may be made of different optically transmissive materials. For example the enclosure 50 may be made of glass and the braces 7102 may be made of plastic or the enclosure 50 and braces 7102 may be made of different clear plastics or the enclosure may be made of a diffusive material and the braces may be made of a clear material. In one embodiment the braces 7102 are made of clear plastic and the enclosure 50 is made of glass with a light diffusive layer or properties. By making the braces 7102 clear the braces 7102 transmit light such that the braces do not block light emitted by the LEDs 32 and are not visible or are only slightly visible during operation of the lamp. In one embodiment the braces 7102 may be molded of plastic such that the braces 102 may be made at low cost and with minimal material or processing steps.

In one embodiment each brace 7102 comprises a mounting surface 104 that abuts or faces the back of the LED board 34. Because the typical LED board 34 is a generally planar member having a relatively flat back side, the mounting surface 104 typically comprises a planar member. Where the LED board 34 is formed with other than a flat back side, the mounting surface 104 may be provided with a complimentary shape such that the mounting surface 104 is able to receive the LED board 34.

An engagement member 108, such as a pin, may extend from the mounting surface 104 that is configured to engage a mating engagement member 109, such as an aperture, on the LED board 34. The engagement of the pin 108 with the aperture 109 on the LED board fixes the position of the brace 102 relative to the LED board 34 such that the LED board is constrained from moving relative to the brace. In one embodiment a single pin 108 is located in the center of the mounting surface 104. The pin 108 may have any shape and size provided it can engage a corresponding aperture on the LED board 34. Moreover, more than one pin may be used on each brace 7102. The engagement members may be reversed such that the LED board 34 may be formed with a pin or other male engagement member and the mounting surface 104 may be provided with a mating aperture or other female engagement member. While the brace 7102, as shown in the drawings, is formed as one-piece with the pin, a separate engagement member may be provided where, for example, both the LED board 34 and the brace 102 are provided with apertures and a separate pin or other engagement member is inserted into the apertures on both the LED board 34 and the brace 7102.

A base 110 is formed on the back side of the brace 102 that is configured to position the mounting surface 104 at the desired height in the enclosure 50. The base 110 may be configured such that is abuts and conforms to the inside surface 50*a* of the enclosure 50 over a portion of the circumference of the enclosure. Where, as described herein, the enclosure 50 comprises a tube that has a size and shape similar to a traditional fluorescent tube, the base 110 is formed as a segment of a cylinder where the base 110 fits into and engages the internal surface 50*a* of the enclosure 50. In the illustrated embodiment the base is formed by a plurality of members 200 that extend from the mounting surface 104 and terminate on a radius of a circle where the radius defined by the members 200 is approximately the same, or slightly smaller than, the internal radius of the interior surface 50*a* of the enclosure 50 such that the members 200 abut the internal surface 50*a* of the enclosure 50. Where the enclosure 50 has a shape other than a tube the members may terminate in a complimentary shape.

Figure 26:
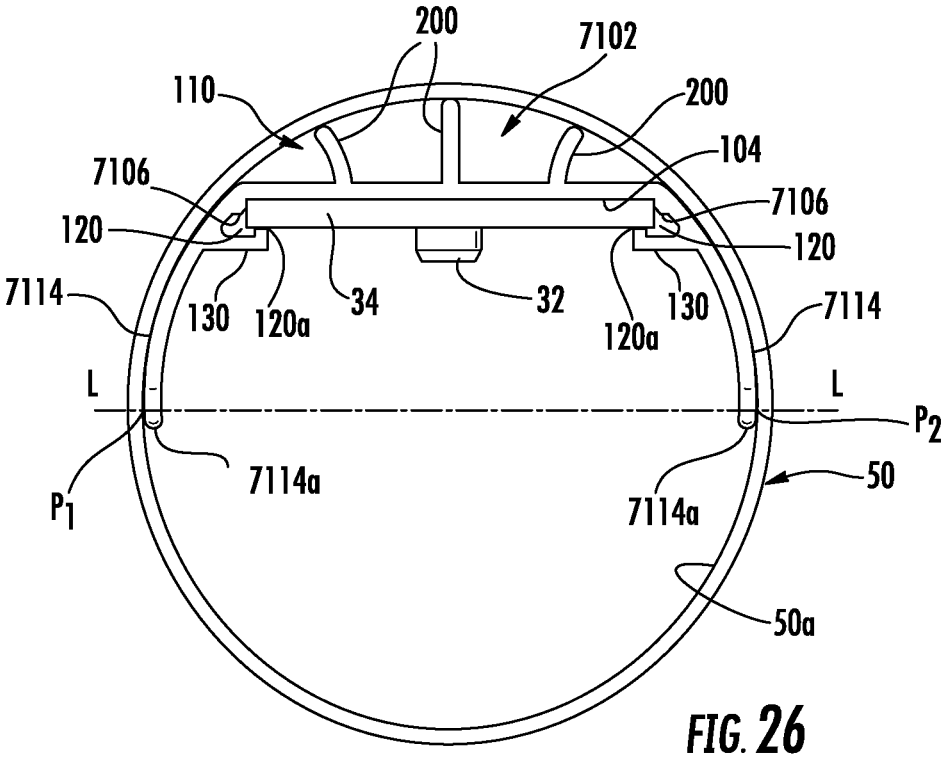
FIG. 26 is a front view of the brace of FIG. 20 mounted in an enclosure and supporting an LED board.

A member such as a leg 7114 extends from the base 112 at each side of the mounting surface 104. Each member or leg 7114 is shaped to rest against the interior 50*a* surface of the enclosure 50. The width of the mounting surface 104 between the legs 7114 is approximately the same or slightly greater than the width of the LED board 34. In one embodiment flanges or abutments 7106 are formed along the edges of the mounting surface 104 such that the LED board 34 may be placed on the mounting surface 104 such that the longitudinal edges of the LED board 34 are constrained between the flanges 7106. The legs 7114 are shaped as a radius of a circle where the radius defining the legs 7114 is approximately the same, or slightly smaller than, the radius of the interior surface 50*a* of the enclosure 50 such that the legs 7114 abut the internal surface 50*a* of the enclosure 50. The legs 7114 are configured such that when the brace 7102 is inserted into the enclosure 50 the legs contact the interior surface 50*a* of the enclosure 50 over substantially the entire length of the legs. The distal ends 7114*a* of the legs 7114 terminate at or just beyond the horizontal centerline L-L of the enclosure 50. By terminating the legs 7114 at or just beyond the centerline L-L of the enclosure 50 the distance between the ends 7114*a* of the legs 7114 is as large as the largest width (the diameter in a tubular enclosure) of the enclosure 50. As a result when the lamp is mounted in a fixture, such that the brace 7102 is at the top of the enclosure (as shown in FIG. 26), the distance between the ends 7114*a* of the arms 7114 prevents the brace 7102 (and LED board 34) from moving toward the front of the enclosure. Because the arms extend only to approximately the diameter L-L of the lamp, the arms block little if any light emitted from the front of the lamp. Comparing the brace of FIG. 26 with the brace of FIG. 9, for example, the brace of FIG. 26 does not block any light emitted toward the front half of the enclosure 50 while the brace of FIG. 9 may create dark spots where the legs 114 contact the enclosure 50. The legs 7114 may be slightly deformed inwardly when the brace 7102 is mounted in the enclosure 50 such that the legs 7114 are biased to exert a slight force on the enclosure 50. The brace 7102 may be made of a resilient material such as plastic such that when the legs 7114 are deformed the material of the legs create the bias force.

The enclosure 50 may have a generally tubular shape having a circular cross-section where the internal surface 50*a* of the enclosure 50 is a tube. The centerline L-L as shown in the drawings defines a plane that is located at the horizontal diameter of the enclosure and that divides the enclosure into a first portion that comprises a front half and a second portion that comprises a back half. The legs 7114 are configured to define arcs of a circle such that the outer surface of the arms is curved and has a radius that is approximately equal to the radius of the internal surface 50*a* of enclosure 50 such that the outer surface of the legs abuts the internal surface 50*a* of the enclosure 50. The circumferential distance between the ends 7114*a* of the legs is approximately equal to one half the circumference of the internal surface 50*a*. The ends of the legs 7114*a* extend between the two points of intersection P1 and P2 of the plane defined by the centerline L-L and the internal surface 50*a* of the enclosure 50. The linear distance between the ends of the legs is approximately equal to the internal diameter of the enclosure 50. By making the maximum distance between the legs equal to the internal diameter of the enclosure, when the lamp is installed in a fixture with the LEDs facing down the brace 7114 is constrained from moving vertically downward. While the legs may extend well beyond the plane defined by centerline L-L and maintain the LED board in the proper position the further the ends of the legs extend beyond the plane defined by centerline L-L the more downlight the legs will block and the more visible the legs will be during operation of the lamp. Thus by arranging the ends of the legs to be at or near the plane defined by the centerline L-L (the maximum width of the enclosure), the legs 7114 hold the LED board in the desired position while blocking a minimum amount of downlight such that the braces 7102 are not visible during operation of the light.

Figure 27:
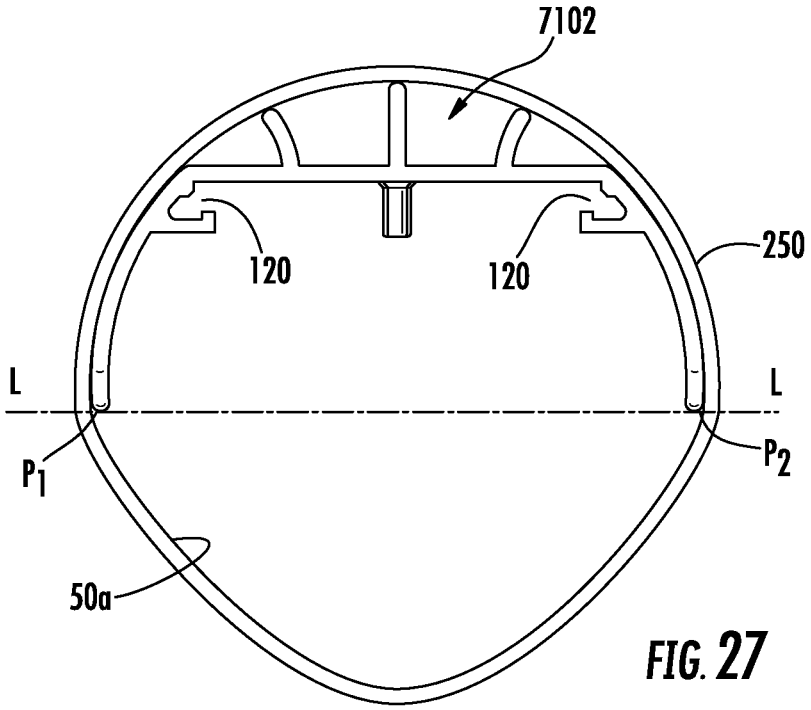
FIG. 27 is a front view of the brace of FIG. 20 mounted in another embodiment of an enclosure.
Figure 28:
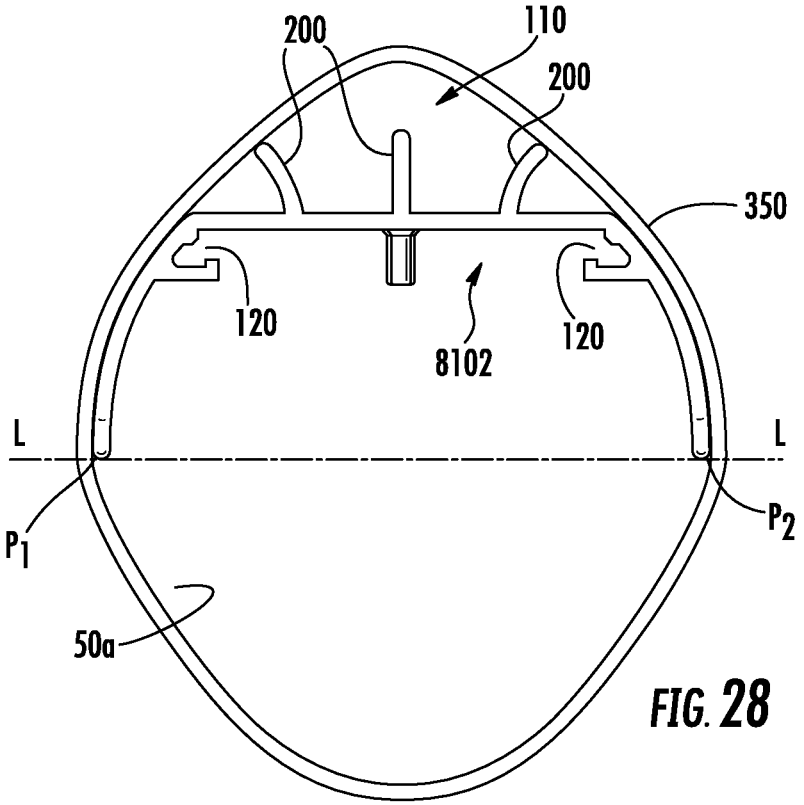
FIG. 28 is a front view of the brace of FIG. 20 mounted in yet another embodiment of an enclosure.
Figure 29:
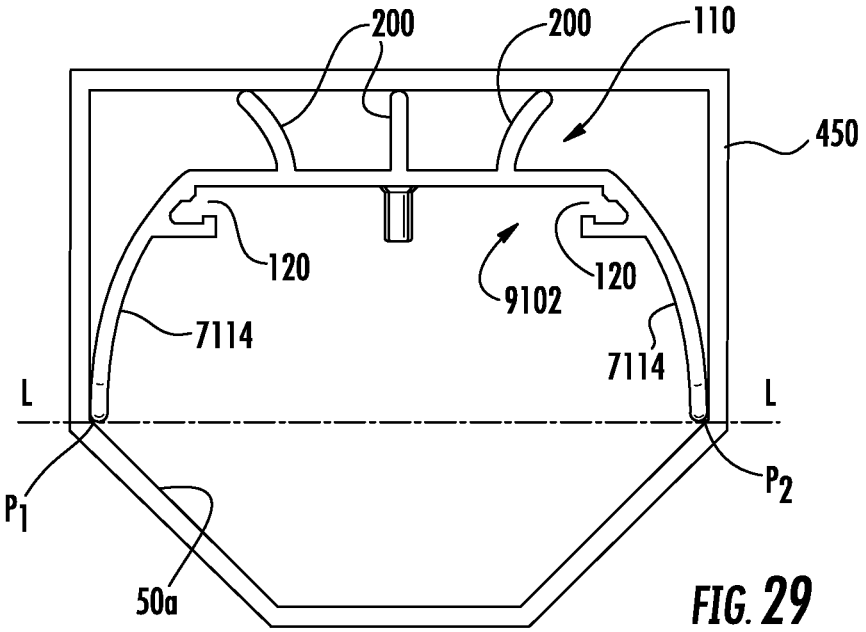
FIG. 29 is a front view of an alternate embodiment of the brace of FIG. 20 mounted in yet another embodiment of an enclosure.
Figure 31:
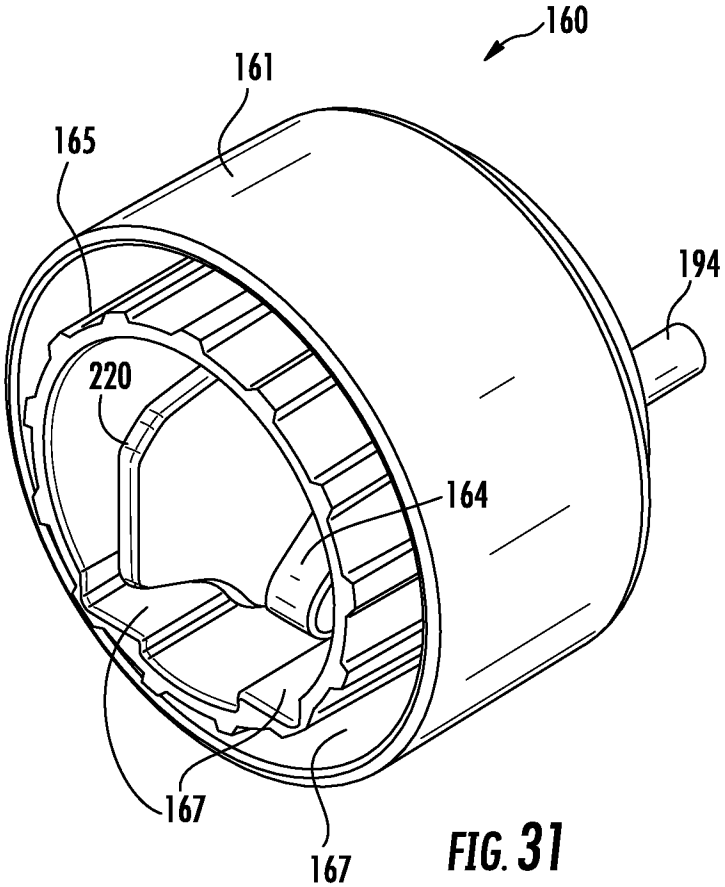
FIG. 31 is a second perspective view of the end cap of FIG. 30.
Figure 30:
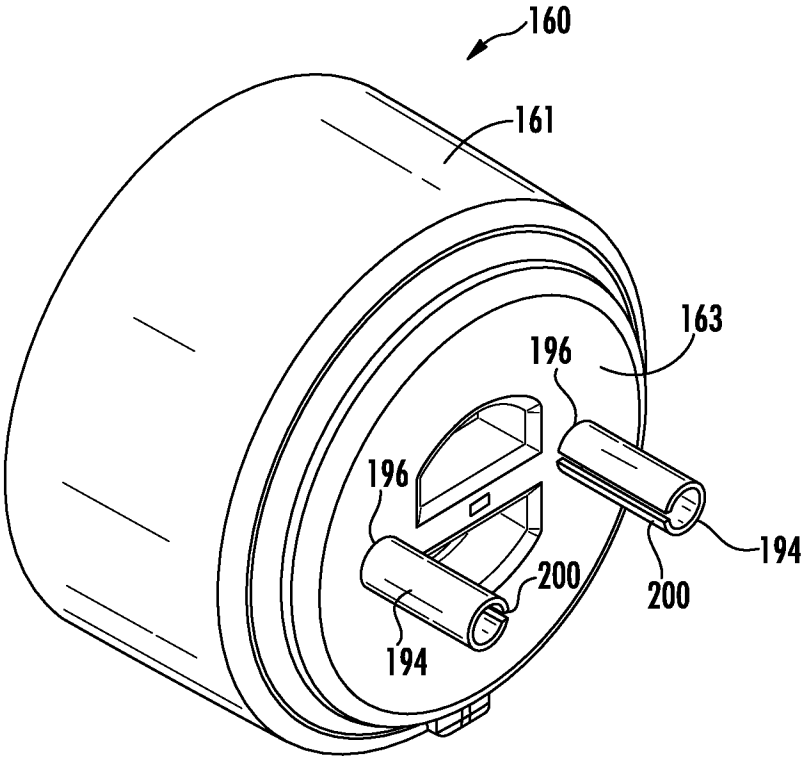
FIG. 30 is a first perspective view of an embodiment of an end cap of the invention.
Figure 32:
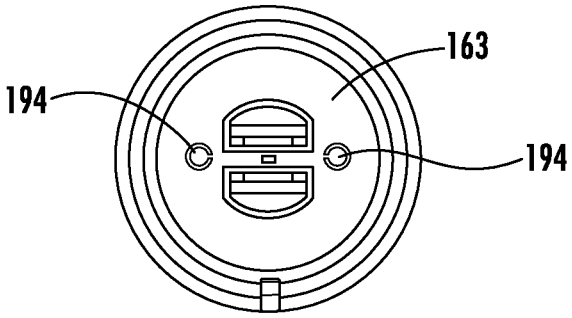
FIG. 32 is a front view of the end cap of FIG. 30.
Figure 33:
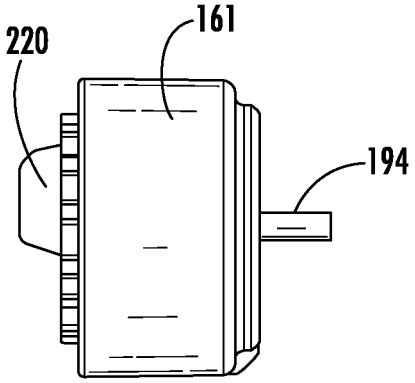
FIG. 33 is a side view of the end cap of FIG. 30.
Figure 34:
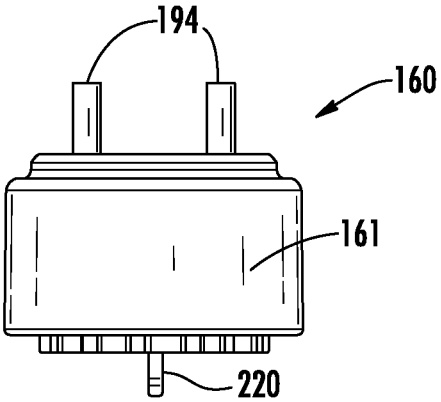
FIG. 34 is a top view of the end cap of FIG. 30.
Figure 36:
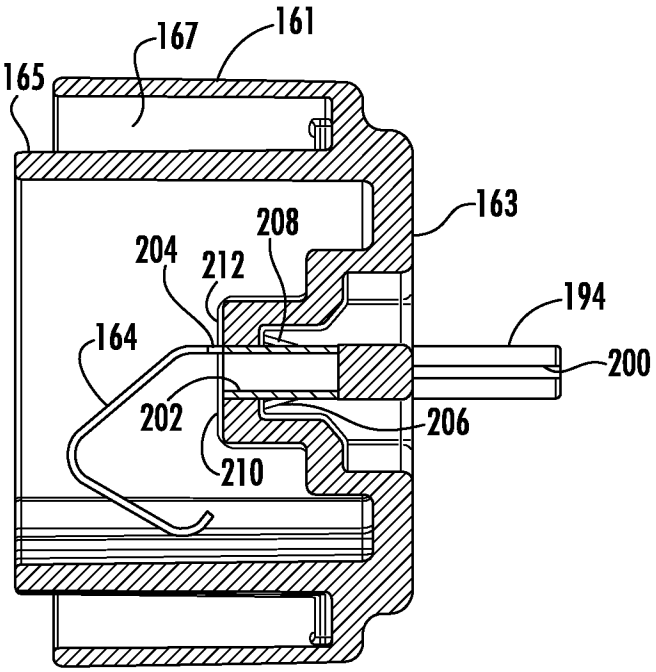
FIG. 36 is a section view taken along line 36-36 of FIG. 35.
Figure 35:
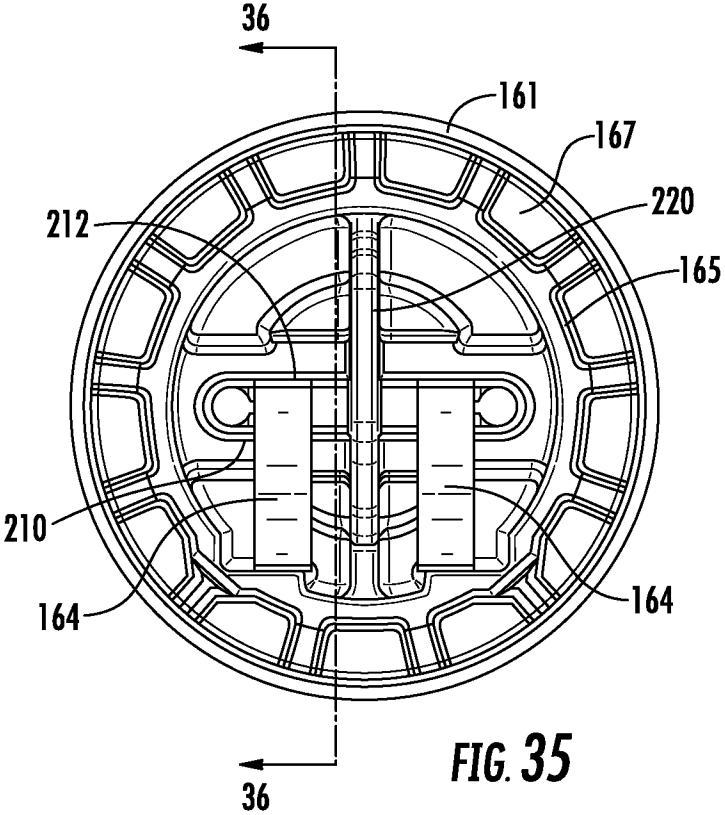
FIG. 35 is a back view of the end cap of FIG. 30.

While the arrangement of the brace 7102 and the enclosure 50 has been described with respect to a tubular enclosure having a circular cross-section, the arrangement of the brace will function with any shaped enclosure that narrows from the horizontal plane defined by a line L-L toward the front of the enclosure. FIGS. 27-29 show alternate arrangements of the enclosure and brace. FIG. 27 shows the brace 7102 mounted in an enclosure 250 having a first portion having a circular cross-section toward the back of line L-L and a second portion having a tapered oval cross-section toward the front of line L-L. Because the enclosure 250 narrows in front of line L-L the maximum distance between the legs holds the brace in position. FIG. 28 shows an enclosure 350 having a first portion that is a tapered oval cross-section to the front of line L-L and a second portion that is a tapered oval cross-section to the back of line L-L. Brace 8102 is configured such that two of the members 200 of base 110 contact the internal wall of enclosure 350 but one of the member s does not contact the internal wall 50*a*. FIG. 29 shows an enclosure 450 defined by planar walls where the enclosure narrows from a back portion in back of line L-L to a front portion in front of line L-L. Brace 9102 is configured such that the members 200 of base 110 contact the internal wall of enclosure 350. The legs 7114 in the embodiment of FIG. 29 do not contact the enclosure over their entire length.

The end of the first leg extends to a first point of intersection P1 of the plane L-L and the internal surface of the enclosure and the end of the second leg extends to a second point of intersection P2 of the plane L-L and the internal surface of the enclosure where the enclosures narrow from the points of intersection toward the front of the lamp such that the engagement of the ends of the legs with the enclosure prevents the brace and LED board from moving toward the front of the enclosure. Configuring the legs and the base to engage the internal surface of the enclosure prevents the brace and LED board from rattling in the enclosure; however, the legs and/or base do not necessarily have to contact the enclosure along their entire length as shown in the embodiment of FIGS. 28 and 29.

A channel 120 is formed near the bottom of each of the legs 7114 coextensive with the mounting surface 104. Each channel 120 may be formed between mounting surface 104 and a lip 130. The channels 120 are dimensioned to receive lateral edges of the LED board 34 when the LED board 34 is mounted on the brace 102. While the channels 120 are formed at the bottom of the legs 7114 the channels 120 may be formed anywhere along the edges of the mounting surface 104, for example, as part of flanges 106. The brace 102 may be made of a resilient material such as plastic such that the legs 7114 and/or base 110 may be slightly deformed to allow the longitudinal edges of the LED board 34 to be inserted into the channels 120. Moreover, some LED boards such as a PCB with FR4 and flex circuit are also slightly deformable such that the LED board 34 may also be slightly deformed as it is inserted into the channels 120. Once the LED board 34 is inserted into the channels 120 the front surfaces 120*a* of the channels 120 abut or are in close proximity to the front surface of the LED board 34 such that the LED board is supported by the surfaces 120*a* during use of the lamp and the LED board 34 cannot be removed from the brace 102 without deforming the brace 102 and/or the LED board 34. Because the legs 7114 and the base 110 abut the interior wall 50*a* as previously described the brace 102 cannot be deformed to release the LED board 34 once the braces 7102 and LED board 34 are mounted in the enclosure 50. The channels 120 may be dimensioned and configured to closely receive the LED board such that the LED board is held under slight pressure and/or a friction fit in the channels 120.

While a brace 7102 having two legs 7114 is shown, the brace 7102 may comprise multiple legs on each side of the mounting surface 104. Moreover, the legs 7114 can have a shape that is different from that shown in the drawings. As previously explained, the braces 7102 may extend for any portion of the length of the LED board 34 provided that the braces 7102 support and align the LED board 34 in the enclosure 50. In some embodiments each brace 7102 may extend for approximately one inch and be spaced approximately 12 inches from one another. However, the braces 7102 may be longer or shorter and may be spaced closer together or farther apart depending upon the amount of support needed by the LED board 34. A more flexible LED board may use longer braces, more braces and/or space the braces closer together while a more rigid LED board may use fewer braces, smaller braces and/or space the braces farther apart. In one embodiment the brace 7102 may extend for the entire length of the enclosure 50 such that the LED board is supported over its entire length. Numerous other changes in the relative sizes and shapes of the components of the support may also be made.

In another embodiment beads of adhesive are applied to the enclosure 50 at the desired positions of the braces. Typically a plurality of beads of adhesive are applied; however, if a single brace is used a single bead of adhesive may be applied. A fixture supporting the braces in the desired relative positions is inserted into the enclosure 50 from one end of the enclosure until the braces are positioned opposite the beads of adhesive. The fixture is moved towards the enclosure 50 to set the braces on the adhesive. The fixture may be reciprocated slightly to evenly spread the adhesive. The fixture releases the braces and is removed from the enclosure 50. After the adhesive cures, the LED board 34 may be inserted into the channels 120 on the braces from one end of the enclosure. In some embodiments, the braces may be secured to the LED board prior to insertion into the enclosure and the fixture may insert the LED board and the braces into the enclosure as a unit. In other embodiments the adhesive may be applied to the braces before the braces are inserted into the enclosure. To complete the assembly electrical connections are made from the pins 94 on the end caps 60 to the LED board and the end caps 60 are secured to the opposite ends of the enclosure 50.

The LED board 34 may be made of or covered in a reflective material, e.g., MCPET, white optic, or the like, to reflect light from the mixing chamber 51. The entire LED board 34 may be made of or covered in a reflective material or portions of the board may be made of or covered in a reflective material. For example, portions of the LED board that may reflect light may be made of reflective material.

End caps 60 may be provided at the opposite ends of the enclosure 50 to close the interior mixing chamber 51 of LED lamp 100 and to support the electrical connectors 94 for electrically connecting the lamp to the tombstone connectors 10 of the housing. The end caps 60 and enclosure 50 define the mixing chamber 51 for the light.

Figure 16:
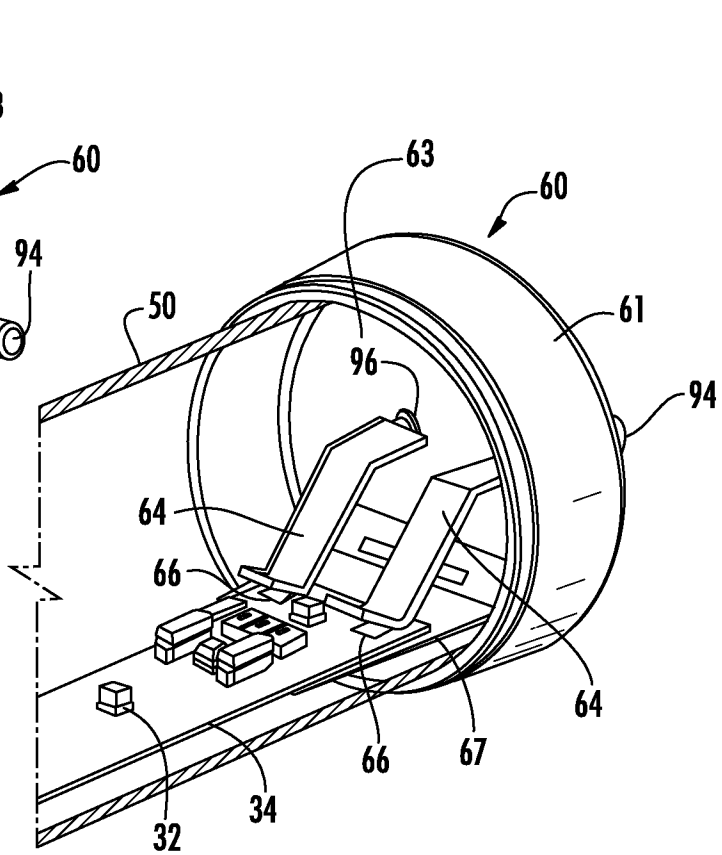
FIGS. 15 and 16 are a partial perspective views showing an embodiment of an enclosure and end cap usable in the LED lamp of the invention.
Figure 15:
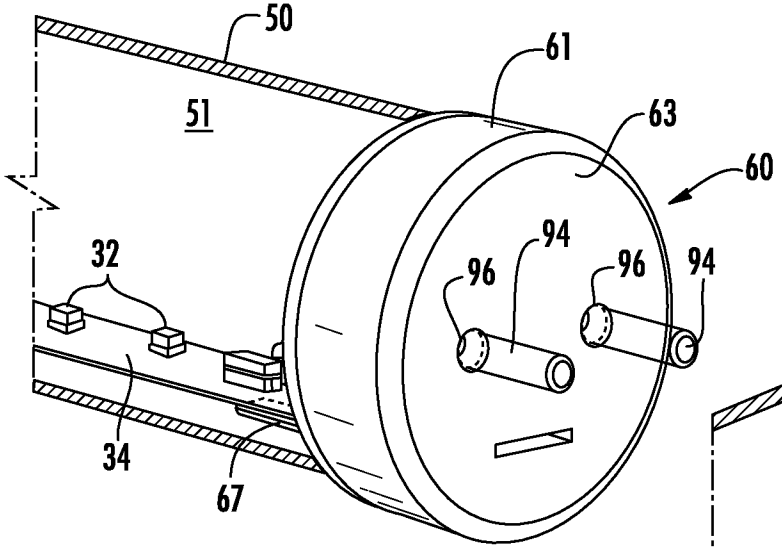

The end caps 60 are identical such that the structure and operation of one end cap will be described. Referring to FIGS. 15 and 16, the end cap 60 comprises an internal chamber defined by a side wall 61 and an end wall 63 configured to closely receive the enclosure 50. The end wall 63 supports a pair of pins 94 in apertures 96. The pins 94 are positioned and dimensioned to mechanically and electrically engage the traditional tombstone connectors found in a fluorescent fixture. In some embodiments a single pin 94 may be used to complete the electrical connection where the second pin 94 may be used only to provide physical support for the lamp in the tombstone connectors. The pins 94 may be fixed in the end caps 60 using any suitable connection mechanism including a press fit, adhesive, mechanical connector, insert molding or the like. The pins 94 extend through the end wall 63 such that a portion of the pins communicate with the interior of the lamp to create electrical conductors 104.

In one embodiment, the enclosure 50 is slid into the end cap 60 and adhesive is used to secure the end caps 60 to the enclosure 50. In other embodiments a snap-fit connection may be used to secure the end caps 60 to the enclosure 50. In one embodiment the end cap 60 is provided with tangs that engage detents formed on the enclosure. Alternatively, these components may be reversed and the end cap 60 may be provided with the detents and the enclosure 50 may be provided with the tangs. The male members on one of the enclosure 50 or end cap 60 engage the female members on the other of the enclosure 50 or end cap 60 when the enclosure is inserted into the end cap 60. The end caps 60 and/or the enclosure 50 may be slightly resiliently deformable such that as the enclosure 50 is inserted into the end cap 60 the components deform relative to one another to allow a snap-fit connection to be made. These members may be dimensioned such that a friction fit is created between the enclosure and the end caps to further secure the end caps 60 to the enclosure. Other arrangements of a snap-fit connector may be used. While use of a snap-fit connector and/or adhesive provides a simple assembly method, the end caps 60 may be connected to the enclosure 50 using other connection mechanisms such as separate fasteners or the like.

Electrical conductors 64 are electrically coupled to the pins 94 and to electrical contacts 66 formed on the LED board 34 to complete the electrical path between the pins 94 and the LED assembly 30. In one embodiment, the conductors 64 and the pins 94 are formed of a single piece of conductive material where the pin 94 and its related conductor 64 are a single one-piece member. For example the conductors 64 and pins 94 may be formed from a cylindrical bar. The bar may be dimensioned to create pin 94 at on end thereof and a continuous stamping operation or other manufacturing process may be used to form the opposite end of the bar into the flat resilient conductor 64. In one embodiment the conductors 64 may comprise resilient members that may be biased into engagement with contacts 66 on the LED board 34 as shown in FIG. 16. The conductors 64 comprise resilient members made of an electrically conductive material such as copper. Each conductor 64 has a first end supported at the end cap 60. The opposite ends of the conductors 64 extend into the internal space of the end cap 60 where the conductors 64 make contact with electrical contacts 66 on the LED board 34. The conductors 64 are configured and supported such that the conductors 64 are resiliently deformed by engagement with the LED board 34 such that the free ends of the conductors 64 are biased into engagement with the contacts 66. The electrical coupling between the conductors 64 and the contacts 66 is referred to herein as "contact coupling" where the electrical connection is made by the contact of the conductors with the contacts under pressure without the use of solder. An insulator may be provided between the conductors 64 to electrically insulate the conductors from one another. An electrical path is created between the pins 94 and the LED board 34 to provide both sides of critical current to the LED assembly.

A ramp 67 may extend from the end cap 60 and be inserted underneath the LED board 34 when the end cap 60 is inserted over the enclosure 50. The ramp 67 supports the end of the LED board 34 to ensure that the LED board is properly positioned and supported to make the contact coupling with the conductors 64 to ensure a good electrical connection. To insert the lamp into an existing fixture the entire lamp may be rotated in the same manner as a traditional fluorescent tube to insert the pins 94 in the tombstone connectors.

In another embodiment the pins 94 may be electrically coupled to the LED board 34 using conductors that are soldered or otherwise fixed to the LED board contacts 66 and that are electrically coupled to the pins 94. In one embodiment the conductors may comprise wires, ribbons or the like. The conductors are electrically coupled to the pins 94 and may be soldered or otherwise electrically coupled to the electrical contacts 66 on the LED board 34. After the conductors are electrically connected to the LED board 34, the end caps 60 may be attached to the enclosure 50 to complete the lamp.

Another embodiment of an end cap 160 is shown in FIGS. 30-43. End caps 160 may be provided at the opposite ends of the enclosure 50 to close the interior mixing chamber 51 of LED lamp 100 and to support the electrical connectors 194 for electrically connecting the lamp to the tombstone connectors 10 of the housing. The end caps 160 and enclosure 50 define the mixing chamber 51 for the light. The end caps 160 are identical such that the structure and operation of one end cap will be described. The end cap 160 comprises an internal chamber defined by a side wall 161 and an end wall 163 configured to closely receive the enclosure 50. In one embodiment an internal annular wall 165 extends from the end wall 163 and is located inside of the side wall 161 to create an annular space 167 for receiving the enclosure 50. The end wall 163 supports a pair of pins 194 in apertures 196. The pins 194 are positioned and dimensioned to mechanically and electrically engage the traditional tombstone connectors found in a fluorescent fixture. In some embodiments a single pin 194 may be used to complete the electrical connection where the second pin 194 may be used only to provide physical support for the lamp in the tombstone connectors. The pins 194 may be fixed in the end caps 60 such that the pins 194 communicate with the interior of the lamp to create electrical conductors 164 as will hereinafter be described.

In one embodiment, the enclosure 50 is slid into the end cap 160 and adhesive is used to secure the end caps 160 to the enclosure 50. In other embodiments a snap-fit connection may be used to secure the end caps 160 to the enclosure 50. In one embodiment the end cap 160 is provided with tangs that engage detents formed on the enclosure. Alternatively, these components may be reversed and the end cap 160 may be provided with the detents and the enclosure 50 may be provided with the tangs. The male members on one of the enclosure 50 or end cap 160 engage the female members on the other of the enclosure 50 or end cap 160 when the enclosure is inserted into the end cap 160. The end caps 160 and/or the enclosure 50 may be slightly resiliently deformable such that as the enclosure 50 is inserted into the end cap 160 the tangs deform to allow a snap-fit connection to be made. These members may be dimensioned such that a friction fit is created between the enclosure and the end caps to further secure the end caps 160 to the enclosure. Other arrangements of a snap-fit connector may be used. While use of a snap-fit connector and/or adhesive provides a simple assembly method, the end caps 160 may be connected to the enclosure 50 using other connection mechanisms such as separate fasteners or the like.

Figure 37:
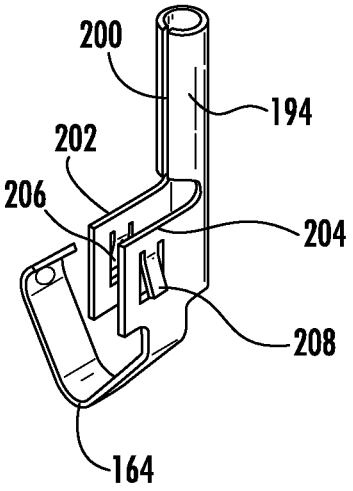
FIG. 37 is a first perspective view of an embodiment of a pin/conductor assembly of the invention.
Figure 38:
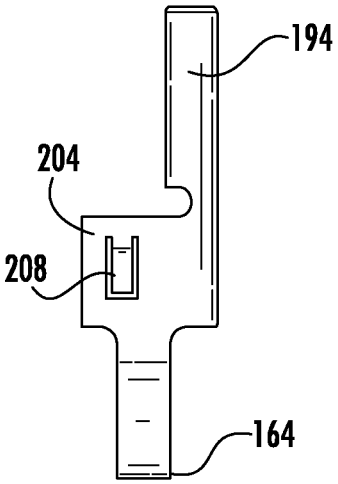
FIG. 38 is a front view of the pin/conductor assembly of FIG. 37.
Figure 39:
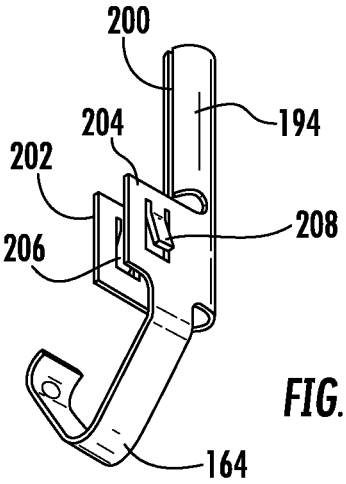
FIG. 39 is a second perspective view of the pin/conductor assembly of FIG. 37.
Figure 40:
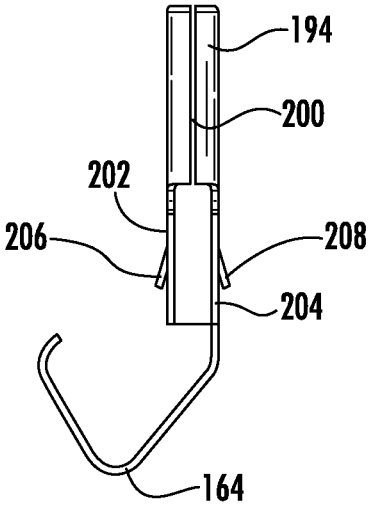
FIG. 40 is a side view of the pin/conductor assembly of FIG. 37.
Figure 41:
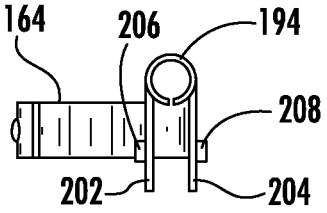
FIG. 41 is an end view of the pin/conductor assembly of FIG. 37.
Figure 42:
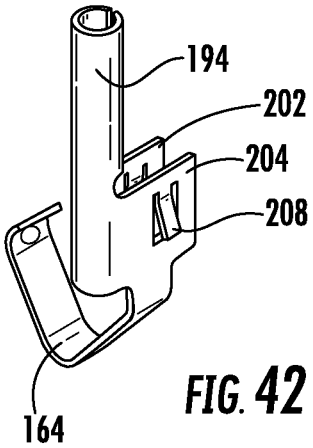
FIG. 42 is a first perspective view of an embodiment of a second pin/conductor assembly of the invention.

Electrical conductors 164 are electrically coupled between the pins 194 and to electrical contacts 66 formed on the LED board 34 to complete the electrical path between the pins 194 and the LED assembly 30. In one embodiment, the conductors 164 and the pins 194 are formed of a single piece of conductive material where the pin 194 and its related conductor 164 are a single one-piece member. On embodiment of the one-piece pin 194 and conductor 164 is shown in FIGS. 37-42. FIGS. 37-41 show the right hand pin/conductor assembly and FIG. 42 shows the left hand pin/conductor of FIG. 30. The pin/conductor assemblies shown in FIGS. 37 and 42 are mirror images of one another such that specific reference will be made to the pin/conductor assembly of FIGS. 37-42. While left hand and right hand pin/conductors are used in the illustrated embodiment in some embodiments the two pin/conductors in each end cap 160 may be identical.

Referring to FIGS. 37-41 each pin/conductor assembly may be made of a single piece of electrically conductive material that is rolled and/or stamped to create the pin/conductor assemblies used in the end caps 160. Specifically the pin/conductor assembly may be made of stainless steel to closely match the galvanic properties of the brass tombstone connectors and the tin contacts 66 on the LED assembly 30. A flat piece of conductive material may be rolled to create the pin 194. Because the pin 194 is rolled, the pin 194 is hollow and a seam 200 is formed between the two ends of the rolled material. A pair of opposed flanges 202, 204 are also formed at one end of the pin 194. Flange 202 is formed with a barb or tang 206 that extends outwardly from the flange 202 and flange 204 is formed with a barb or tang 208 that extends outwardly from the flange 204. The tangs may be stamped into the flanges before the material is rolled. A conductor 164 extends from one of the flanges as is bent to form a contact that may be biased into engagement with the contacts 66 on the LED board 34. The conductor 164 may extend from either flange 202 or 204 or from the pin 194.

To assemble the end cap 160 the pin 194 is inserted into one of the holes 196 formed in the end wall of the end cap 160 from the inside of the end cap. A pair of spaced walls 210, 212 are formed on the interior of end wall 163 where the walls are spaced to closely receive the flanges 202, 204. The distance between the walls 210, 212 is approximately the same as the distance between the outer surfaces of flanges 202, 204. As a result, as the pin/conductor assembly is inserted into the end cap the tangs 206, 208 contact the walls 210, 212 such that the tangs 206, 208 and/or flanges 202, 204 are compressed towards one another. The tangs 206, 208 are formed at an angle relative to the insertion direction such that contact of the sloping surfaces of the tangs with the walls 210, 212 forces the tangs 206, 208 and flanges 202, 204 toward one another to allow the tangs to pass the walls 210, 212. When the distal ends of the tangs 206, 208 reach the ends of the walls 210, 212, the tangs 206, 208 return toward their undeformed state such that the tangs 206, 208 extend beyond and abut the walls 210, 212. The engagement of the tangs 206, 208 with the walls 210, 212 prevents the pin/conductor assemblies from being removed from the end caps 160.

Figure 43:
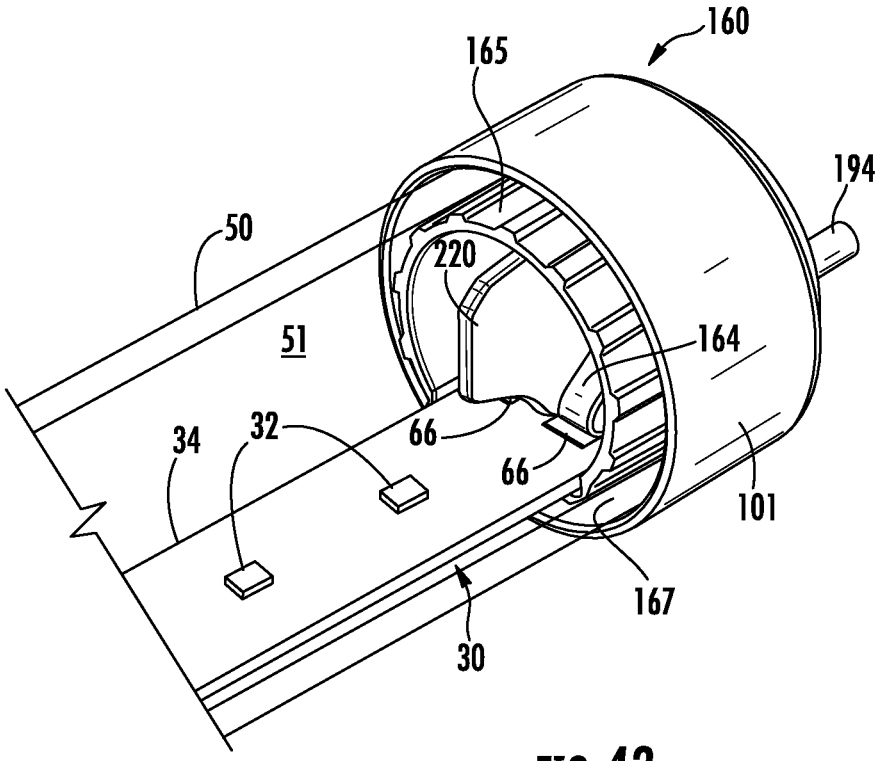
FIG. 43 is a perspective view of an embodiment of the end cap of FIG. 30 mounted on an enclosure containing an LED assembly.

The conductors 164 comprise resilient members that are biased into engagement with contacts 66 on the LED board 34 as shown in FIG. 43. The free ends of the conductors 164 extend into the internal space of the end cap 160 where the conductors 164 make contact with electrical contacts 66 on the LED board 34. The conductors 164 are configured and supported such that the conductors 164 are resiliently deformed by engagement with the LED board 34 as the LED board is slid into the end caps such that the free ends of the conductors 164 are biased into engagement with the contacts 66. The electrical coupling between the conductors 164 and the contacts 66 is referred to herein as "contact coupling" where the electrical connection is made by the contact of the conductors with the contacts under pressure without the use of solder or wires. An insulator 220 may be provided between the conductors 64 to electrically insulate the conductors from one another. An electrical path is created between the pins 194 and the LED board 34 to provide both sides of critical current to the LED assembly.

A support surface 167 is positioned underneath conductors 164 to support the LED board 34 when the end cap 160 is inserted over the enclosure 50. The support surface 167 supports the end of the LED board 34 to ensure that the LED board is properly positioned and supported to make the contact coupling with the conductors 164 to ensure a good electrical connection. To insert the lamp into an existing fixture the entire lamp may be rotated in the same manner as a traditional fluorescent tube to insert the pins 94 in the tombstone connectors.

In another embodiment the pins 94 may be electrically coupled to the LED board 34 using conductors that are soldered or otherwise fixed to the LED board contacts 66 and that are electrically coupled to the pins 94. In one embodiment the conductors may comprise wires, ribbons or the like. The conductors are electrically coupled to the pins 94 and may be soldered or otherwise electrically coupled to the electrical contacts 66 on the LED board 34. After the conductors are electrically connected to the LED board 34, the end caps 60 may be attached to the enclosure 50 to complete the lamp.

In some embodiments an antenna may be provided in the bulb for receiving, and/or transmitting, a radio signal or other wireless signal between the lamp and a control system and/or between lamps. The antenna may convert the radio wave to an electronic signal that may be delivered to the lamp electronics 110 for controlling operation of the lamp. The antenna may be mounted on the board and be in communication with the lamp electronics. The antenna may also be used to transmit a signal from the lamp. The antenna may be positioned inside of the enclosure 112 such that the base 102 including Edison screw 103 do not interfere with signals received by or emitted from antenna. While the antenna is shown in the enclosure 112, the antenna may be located in the enclosure 112 and/or base 102. The antenna may also extend entirely or partially outside of the lamp. In various embodiments described herein various smart technologies may be incorporated in the lamps as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks," application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No.

13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," Application No. 61/932,058, filed Jan. 27, 2014, which is incorporated by reference herein in its entirety.

In some embodiments color control is used and RF control circuitry for controlling color may also be used in some embodiments. The lamp electronics may include light control circuitry that controls color temperature of any of the embodiments disclosed herein in accordance with user input such as disclosed in U.S. patent application Ser. No. 14/292,286, filed May 30, 2014, entitled "Lighting Fixture Providing Variable CCT" by Pope et al. which is incorporated by reference herein in its entirety.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an elongated at least partially optically transmissive enclosure having a first end and a second end, the enclosure comprising an internal surface having circular cross-section and being divided into a first half and a second half by a theoretical plane defined by a horizontal centerline;

a plurality of LEDs in the enclosure operable to emit light through the enclosure when energized through an electrical path, the plurality of LEDs being mounted on an LED board where the LED board extends for substantially the length of the enclosure and includes opposite longitudinal edges;

a first pin mounted to the first end of the enclosure and a second pin mounted to the second end of the enclosure, the first pin and the second pin being in the electrical path;

a plurality of separate braces spaced from one another along the length of the LED board and mounted to the LED board, each of the plurality of braces comprising a first leg having a first end and a second leg having a second end where the first end extends only to a first point of intersection of the plane and the internal surface of the enclosure and the second end extends only to a second point of intersection of the plane and the internal surface of the enclosure, wherein the first leg and the second leg are configured to define arcs of a circle such that outer surfaces of the first leg and the second leg are curved and have a radius that is approximately equal to a radius of the internal surface of the enclosure such that outer surfaces of the first leg and the second leg abut the internal surface of the enclosure over the length of the first leg and the second leg; and wherein the plurality of braces each comprise a pair of opposed channels for receiving the opposite longitudinal edges of the LED board such that the LED board extends through the opposed slots and the engagement of the opposite longitudinal edges of the LED board with the opposed slots retain the plurality of braces on the LED board.

2. The lamp of claim 1 wherein the internal surface of the enclosure has a circumference and the circumferential distance between the first end of the first leg and the second end of the second leg is approximately equal to one half the circumference.

3. The lamp of claim 1 wherein the internal surface of the enclosure has a diameter and a linear distance between the first end of the first leg and the second end of the second leg is approximately equal to the internal diameter of the enclosure.

4. The lamp of claim 1 wherein the first leg and the second leg are deformed by engagement with the enclosure.

5. The lamp of claim 1 wherein the plurality of braces are formed of optically transmissive material.

6. The lamp of claim 1 wherein the plurality of braces are clear.

7. The lamp of claim 1 wherein the LED board provides physical support for the at least one LED and forms part of the electrical path.

8. The lamp of claim 1 wherein a portion of the enclosure extends behind the LED board.

9. The lamp of claim 1 wherein a width of the enclosure is greater than a width of the LED board.

10. The lamp of claim 1 further comprising a first end cap supporting the first pin and a second end cap supporting the second pin.

11. The lamp of claim 1 comprising a first conductor connecting the first pin to the LED board using a first contact coupling under pressure between the first conductor and the LED board and a second conductor connecting the second pin to the LED board using a second contact coupling under pressure between the second conductor and the LED board.

12. The lamp of claim 11 wherein the first conductor and the second conductor are resilient and the LED board comprises a first contact and a second contact and the first conductor and the second conductor are deformed to create a bias force between the first conductor and the first contact and the second conductor and the second contact to maintain the first contact coupling between the first conductor and the LED board and the second contact coupling between the second conductor and the LED board where the first contact coupling and the second contact coupling maintain the electrical connection between the first conductor and the first contact and between the second conductor and the second contact, respectively, during operation of the lamp.

13. The lamp of claim 12 wherein a support surface is positioned adjacent the LED board to a side of the LED board opposite the first conductor and the second conductor.

14. The lamp of claim 12 wherein the first pin and the first conductor are made of a first piece of electrically conductive material that is bent to form the first pin and the first conductor and the second pin and the second conductor are made of a second piece of electrically conductive material that is bent to form the second pin and the second conductor.

15. The lamp of claim 12 wherein the first pin and first conductor and the second pin and the second conductor are made of stainless steel.

16. The lamp of claim 12 wherein the first pin and the second pin are hollow.

17. The lamp of claim 12 wherein the first pin and the first conductor are retained in the first end cap by a deformable first tang and the second pin and the second conductor are retained in the second end cap by a deformable second tang.

18. The lamp of claim 1 wherein the plurality of braces each comprise a first engagement member that engages a second engagement member on the LED board for fixing the position of the plurality of braces relative to the LED board where the first engagement member and second engagement member comprise at least one of a pin and an aperture.

* * * * *